US007948445B2

(12) United States Patent
Kuramoto

(10) Patent No.: US 7,948,445 B2
(45) Date of Patent: May 24, 2011

(54) WIDEBAND ANTENNA AND CLOTHING AND ARTICLES USING THE SAME

(75) Inventor: Akio Kuramoto, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 12/866,226

(22) PCT Filed: Feb. 17, 2009

(86) PCT No.: PCT/JP2009/052721

§ 371 (c)(1),
(2), (4) Date: Aug. 4, 2010

(87) PCT Pub. No.: WO2009/104617

PCT Pub. Date: Aug. 27, 2009

(65) Prior Publication Data

US 2010/0321273 A1 Dec. 23, 2010

(30) Foreign Application Priority Data

Feb. 18, 2008 (JP) ..... 2008-036025

(51) Int. Cl.
*H01Q 1/50* (2006.01)

(52) U.S. Cl. ..... 343/860

(58) Field of Classification Search ..... 343/860, 343/702, 700 MS, 846, 829–830
See application file for complete search history.

(56) References Cited

U.S. PATENT DOCUMENTS 6,538,604 B1 * 3/2003 Isohatala et al. ..... 343/700 MS
6,847,328 B1 * 1/2005 Libonati et al. ..... 343/700 MS
7,002,526 B1 2/2006 Adams
7,864,127 B2 * 1/2011 Parsche ..... 343/773
2004/0201522 A1 10/2004 Forster
2005/0156804 A1 * 7/2005 Ratni et al. ..... 343/773
2006/0119525 A1 6/2006 Cohen et al.
2006/0164305 A1 7/2006 Chen et al.
2008/0007465 A1 * 1/2008 Gaucher et al. ..... 343/702

FOREIGN PATENT DOCUMENTS

JP 63-138710 A 9/1988
JP 9-223921 A 8/1997
JP 2002158531 A 5/2002
JP 2003258539 A 9/2003
JP 2003309418 A 10/2003

(Continued)

OTHER PUBLICATIONS

International Search Report for PCT/JP2009/052721 mailed May 26, 2009.

(Continued)

*Primary Examiner* — Huedung Mancuso

(57) ABSTRACT

Provided are a first planar radiating element and second planar radiating element that have at least one side. At least the first or second radiating element has a strip-shaped element. A first side of the first radiating element and a second side of the second radiating element are so disposed as to be parallel to each other, face each other and be shifted slightly in a parallel direction. The strip-shaped element is so disposed as to be connected to any side other than the first and second sides of the first and second radiating elements, run parallel to the first and second sides, and not go beyond tips positioned at the outermost points of the first and second sides.

26 Claims, 30 Drawing Sheets

FOREIGN PATENT DOCUMENTS

| | | | |
|---|---|---|---|
| JP | 2004104344 | A | 4/2004 |
| JP | 2005110123 | A | 4/2005 |
| JP | 2005130292 | A | 5/2005 |
| JP | 2005192050 | A | 7/2005 |
| JP | 2006135415 | A | 5/2006 |
| JP | 2007110693 | A | 4/2007 |
| JP | 2007243908 | A | 9/2007 |
| JP | 2007265145 | A | 10/2007 |
| JP | 2007318323 | A | 12/2007 |
| WO | 2006020529 | A | 2/2006 |
| WO | 2007013167 | A | 2/2007 |

OTHER PUBLICATIONS

M. Tanaka et al., "Wearable Patch Antenna", The Institute of Electronics, Information and Communication Engineers, Proceedings of Technical Committee on Antennas and Propagation, Technical Report of IEICE AP2002-76, vol. 102, No. 232, Jul. 2002, pp. 77-80.

* cited by examiner (b)

(a)

WIDEBAND ANTENNA AND CLOTHING AND ARTICLES USING THE SAME

The present application is the National Phase of PCT/JP2009/052721, filed Feb. 17, 2009, which claims priority from Japanese Patent Application No. 2008-036025 filed on Feb. 18, 2008, the entire contents of which being incorporated herein by reference.

TECHNICAL FIELD

The present invention relates to a wideband antenna and particularly, to a wideband antenna which includes two planar radiating elements that are substantially the same in shape and made from conductors, and wear (clothing) and belongings (articles) using the same.

BACKGROUND ART

In recent years, various kinds of outdoor wireless service systems, such as cellular phones, wireless LAN hot spot services and WiMAX (Worldwide Interoperability for Microwave Access), have become available. In the broadcast sector, a digital terrestrial television broadcasting service and the like have started. Improving the performance of an antenna is important in making effective use of various wireless services.

Meanwhile, a wideband antenna is required for a terminal that supports a plurality of the services. Moreover, the problem is that an antenna inside the terminal used for the above services is less sensitive as the terminal becomes smaller. One effective way to solve such problem is to use wearable antenna technology by which an antenna is attached to clothing or bodies. If it is possible to attach an antenna to clothing or the like, the antenna can be made relatively larger. Therefore, the problem of sensitivity is solved. However, a human body is conductive, making it difficult to realize an antenna that works well close to the human body.

In recent years, various frequencies are used for an increasing number of wireless services. One of such services is a current digital radio service that uses a band of 190 MHz. Until recently, a wideband antenna covering 470 MHz to 770 MHz is required for receiving digital territorial television signals. However, it is difficult for a conventional antenna to receive the 190 MHz-band digital radio waves. It is important for an antenna to be used to support as many frequencies as possible. In many cases, among services that users want to use, some use distant frequencies, which the band of the wideband antenna does not cover. In another example, a cellular phone service uses a band of 800 MHz, a cellular phone service uses a band of 2 GHz, a wireless LAN service uses a band of 2.4 GHz/5 GHz, and a WiMAX service uses a band of 2.5 GHz/3.5 GHz; only the cellular phone service with a band of 800 MHz uses a low, distant frequency band. In such cases, an antenna becomes more useful if the antenna can cover another frequency.

An antenna that supports various frequencies and systems will become important for terminals like software radio devices in the future.

For example, as shown FIG. 1, there is a discone antenna as a wideband antenna. The antenna has wideband characteristics and a three-dimensional shape with a conductive circular disc 501 and a conductive circular cone 502 combined.

As shown in FIG. 2, as an antenna that is made of a conductive fabric and can be installed near to a human body, there is a patch antenna made of the fabric. The antenna is disclosed in NPL1. The antenna includes a patch 601 made of the conductive fabric, a ground 602, and an insulating fabric 603 serving as insulator.

CITATION LIST

Patent Literature

{NPL 1} The Institute of Electronics, Information and Communication Engineers, Proceedings of Technical Committee on Antennas and Propagation, (Technical Report of IEICE AP2002-76)

SUMMARY OF INVENTION

Technical Problem

The wideband antenna shown in FIG. 1 has a complicated shape: a coaxial cable 503 enters from the underside of the circular cone 502 and connects and feeds electricity to a central portion. It is difficult to make the shape with a conductive fabric. There are no examples in which the antenna shows excellent matching characteristics when being put near to a human body. A method of feeding electricity without direct soldering is something unprecedented.

Since the antenna shown in FIG. 2 is made of the fabric, the antenna can be freely bent and attached to clothing. However, it is only possible to obtain narrow-band characteristics.

As described above, according to the background arts, there are no planar, thin antennas that cover a wide band, be able to feed electricity without direct soldering, and keep excellent matching characteristics even when being put close to a human body.

Solution to Problem

An exemplary wideband antenna of the present invention includes a first planar radiating element and second planar radiating element that include at least one side, wherein: at least one of the first and second radiating elements has a strip-shaped element; a first side of the first radiating element and a second side of the second radiating element are so disposed as to be parallel to each other, face each other and be shifted in a parallel direction; and the strip-shaped element is so disposed as to be connected to any side other than the first and second sides of the first and second radiating elements, run parallel to the first and second sides, and not go beyond a tip positioned at the outermost point of the first and second sides.

ADVANTAGEOUS EFFECTS OF INVENTION

According to the present invention, a planar, thin dual band antenna that covers a wide band is obtained.

DESCRIPTION OF EMBODIMENTS

Hereinafter, exemplary embodiments of the present invention will be described in detail with reference to the accompanying drawings. Incidentally, an antenna described below is designed to radiate (transmit) signal current as radio waves (electromagnetic waves) into a space or do the opposite by converting (receiving) spatial radio waves (electromagnetic waves) to signal current. However, some of the antenna's components are referred to as radiating elements. Needless to say, the radiating elements are able to receive. The radiating elements are also referred to as antenna elements.

First Exemplary Embodiment

Figure 1:
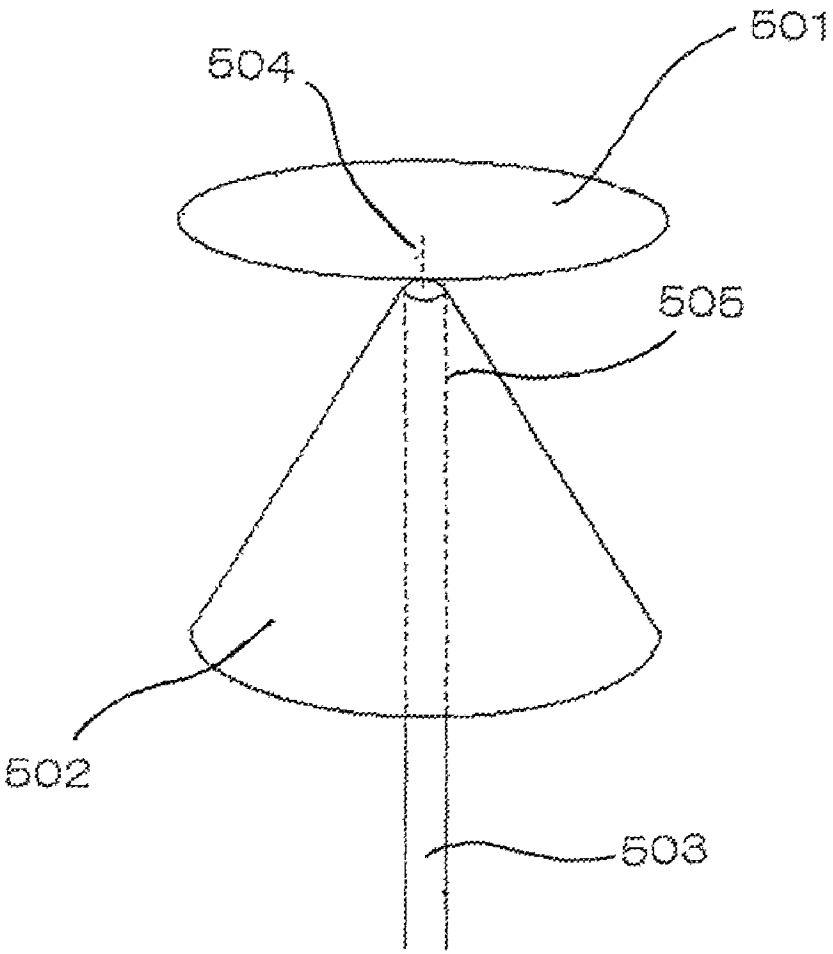
{FIG. 1} A configuration diagram illustrating an example of the configuration of an antenna according to the background art.
Figure 2:
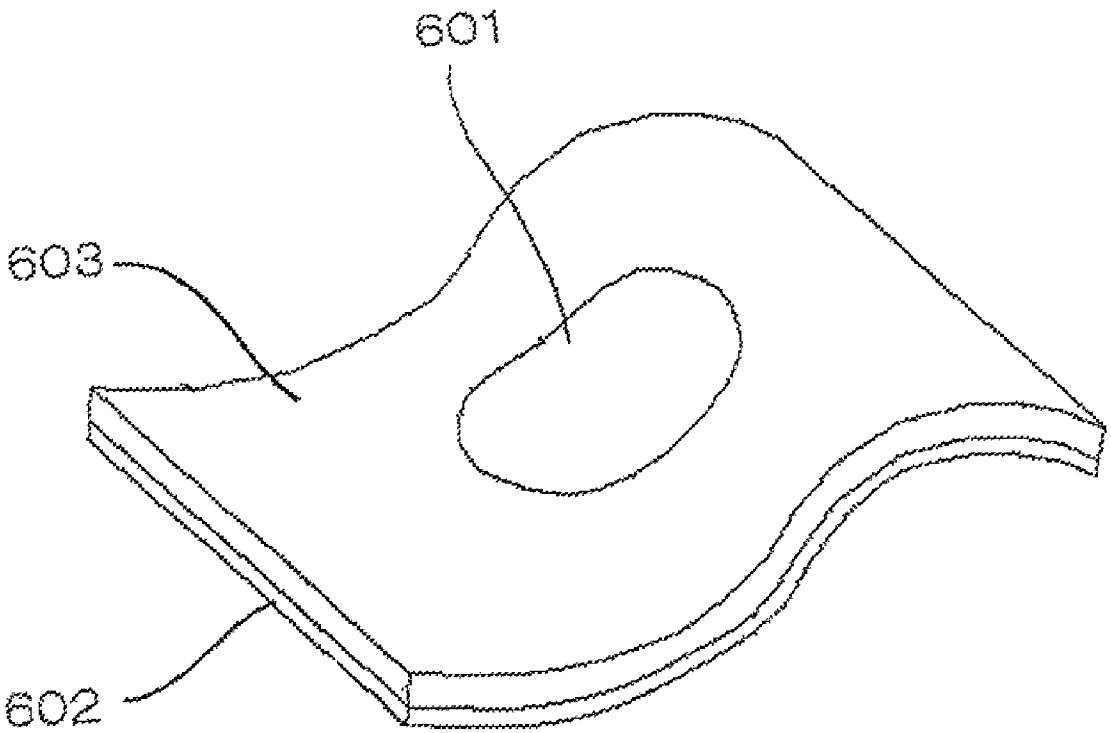
{FIG. 2} A configuration diagram illustrating another example of the configuration of an antenna according to the background art.
Figure 3:
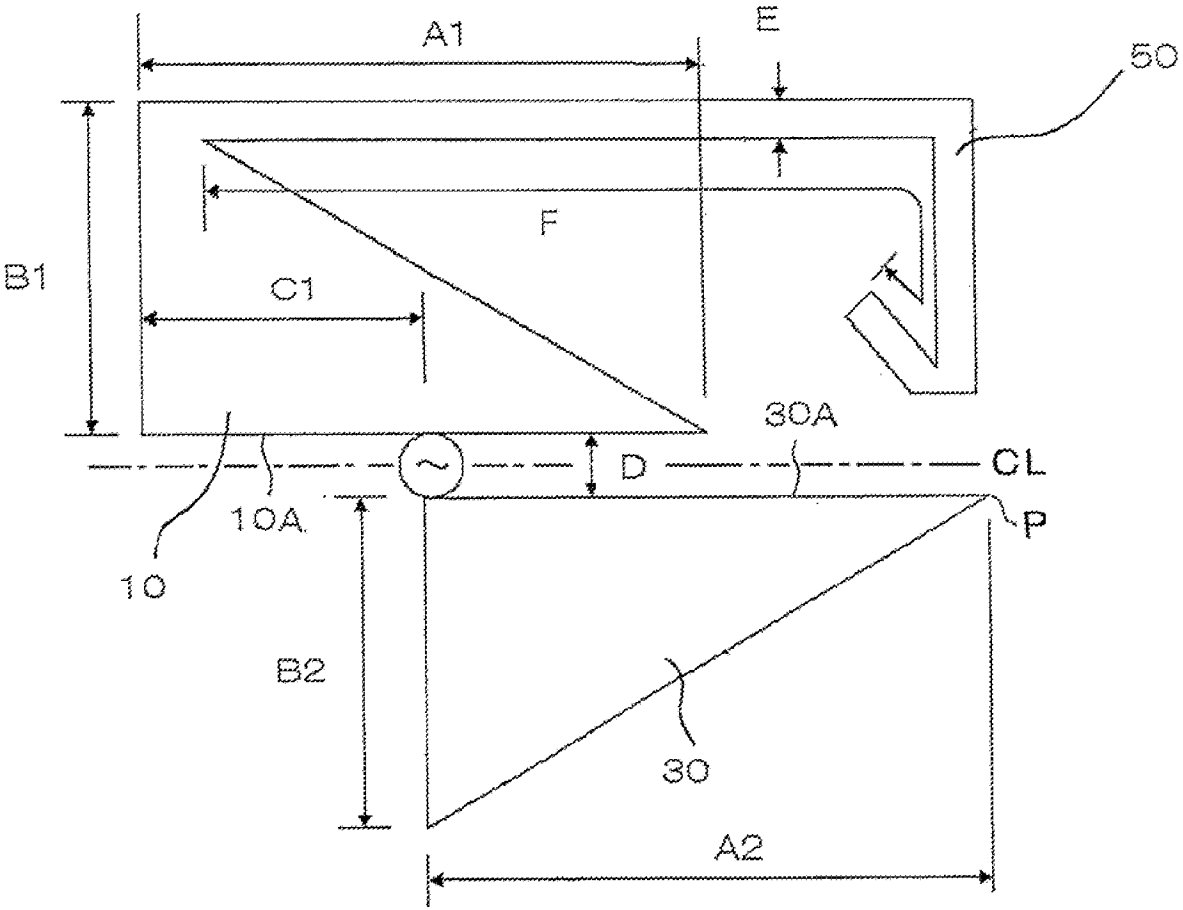
{FIG. 3} A configuration diagram of a wideband antenna according to a first exemplary embodiment of the present invention.

FIG. 3 is a configuration diagram of a wideband antenna according to a first exemplary embodiment of the present invention. The wideband antenna includes a radiating element 10 having a planar conductive plate in the shape of a right triangle, a radiating element 30 similarly having a conductive plate in the shape of a right triangle, and a strip-shaped element 50 having a strip-shaped conductor. One end of the strip-shaped element 50 connects to the radiating element 10 and the other end is open.

It is desirable that the radiating elements 10 and 30 are used to be the same in shape and size. However, since similar effects are obtained even if the radiating elements 10 and 30 are slightly different in shape and size, the radiating elements 10 and 30 may be different in shape and size as long as similar effects are obtained. For example, the difference in length between the sides of the radiating elements 10 and 30 may be within ±20%. In this manner, the phrase "substantially the same shape" means that the two radiating elements may be the same in shape or different in shape and size to such a degree that the radiating elements can obtain similar effects.

The wideband antenna illustrated in FIG. 3 can be used in two frequency bands: a high-frequency band where radiation is carried out mainly from the two radiating elements 10 and 30 that are in the shape of a right triangle, and a low-frequency band where radiation is carried out mainly from the strip-shaped element 50.

The high-frequency band, in which radiation is carried out mainly from the two radiating elements 10 and 30 that are in the shape of a right triangle, has wideband characteristics with a fractional bandwidth of about 83%. The band is beneficial because even if the antenna is used in a free space or near to a dielectric such as a human body or is stuck closely to the dielectric, the antenna can be used without causing impedance characteristics to dramatically deteriorate.

Meanwhile, the low-frequency band, in which radiation is carried out mainly from the strip-shaped element 50, is a narrow band. However, it is possible to have another band to use in addition to the frequency bands of the radiating elements 10 and 30. Moreover, it is relatively easy to adjust the frequency to be used depending on the length of the strip-shaped element.

In FIG. 3, the length A1 of the horizontal side of the radiating element 10 and the length A2 of the horizontal side of the radiating element 30 are usually set at about one-quarter (¼) of the wavelength of a lower-limit usable frequency of the high-frequency band. The length B1 of the vertical side of the radiating element 10 and the length. B2 of the vertical side of the radiating element 30 are usually set at about seventeen-hundredths of the wavelength of the lower-limit usable frequency of the high-frequency band.

The two radiating elements 10 and 30 are so arranged that one side of the radiating element 10 and one side of the radiating element 30 are parallel to each other and symmetrical about a line. Each of the one side of the radiating element 10 and one side of the radiating element 30 is a side other than the hypotenuse. One of the radiating elements is shifted in the direction parallel to the symmetry line of line symmetry (parallel shift) for arrangement. To be specific, when the side 10A of the radiating element 10 faces the side 30A of the radiating element 30, the radiating elements 10 and 30 are so arranged as to be line-symmetrical about a center line (line of symmetry) CL between the facing two sides; the radiating element 10 or 30 is then shifted in the direction parallel to the center line CL and arranged as illustrated in FIG. 3. The two radiating elements 10 and 30 may be the same in shape or different in shape and size to such a degree that the radiating elements 10 and 30 can obtain similar effects. In such cases, the radiating elements 10 and 30 may not be exactly symmetrical about the line. In that manner, the radiating elements 10 and 30 are so arranged that a first side of the radiating element 10 is parallel to a second side of the radiating element 30; the radiating element 10 or 30 is also so shifted that both sides partially face each other. In general, the distance C1 that the radiating element is shifted is preferably about fourteen-hundredths of the wavelength of the lower-limit usable frequency. However, the shifting distance C1 is set at between one-tenth and two-tenths of the wavelength depending on a matching state. The distance D between the radiating elements 10 and 30 is set at between one-thousandth and three-hundredths of the wavelength of the lower-limit frequency.

The strip-shaped element 50 is formed in the shape of a "L" or "J." In principle, the total length F of the inside is equivalent to the center frequency of the lower usable frequency and is set at about one-quarter (¼) of the wavelength. As for the shape of the strip-shaped element 50, it is desirable that the strip-shaped element 50 is extended parallel to the horizontal base of the radiating element 10 that is in the shape of a right triangle, if possible. However, in many cases, there are limitations on space; if the length is insufficient even after the strip-shaped element 50 is bent downward around where the right end of the horizontal upper side of the radiating element 30 is, the tip of the strip-shaped element 50 is bent parallel to the hypotenuse of the radiating element 10. In this case, if the length is a desired length, it is not necessary for the strip-shaped element 50 to be bent in the above complicated shape. According to the configuration of FIG. 3, the strip-shaped element 50 extends parallel to the two sides 10A and 30A of the radiating elements 10 and 30 that partially face each other. The strip-shaped element 50 is so bent as not to go beyond a tip P, the outermost point of the side 30A.

A thin conductor line with a width or diameter of 1 mm or less can be used for the strip-shaped element 50. However, when such things as durability and how easy to produce or make adjustments in terms of structure are taken into account, a thicker conductor line with a width or diameter of about one-hundredths of the wavelength of the center frequency of the lower usable frequency does not have a large impact on the characteristics. When the conductor line is made further thicker, there are no problems if electrical characteristics are adjusted in the process.

In general, a point where the strip-shaped element 50 is connected is around the top vertex of the radiating element 10. However, if there is a good point in terms of impedance matching, the connection point may be located at a given point on the hypotenuse.

Electricity is fed to a point between the position of the shifting distance C1 from the right end of the lower (horizontal) side of the radiating element 10 and the right-angled vertex of the radiating element 30. To feed electricity at the position of the shifting distance C1 means to feed electricity at a predetermined position where the side of the radiating element 10 and the side of the radiating element 30 partially face each other. Two-wire parallel transmission lines or feeder wires such as coaxial cables are connected to feed electricity. In this case, the distance D between the two radiating elements at the feeding section is set at between one-thousandth to three-hundredths of the wavelength of the lower-limit frequency of the high-frequency band.

Second Exemplary Embodiment

Figure 4:
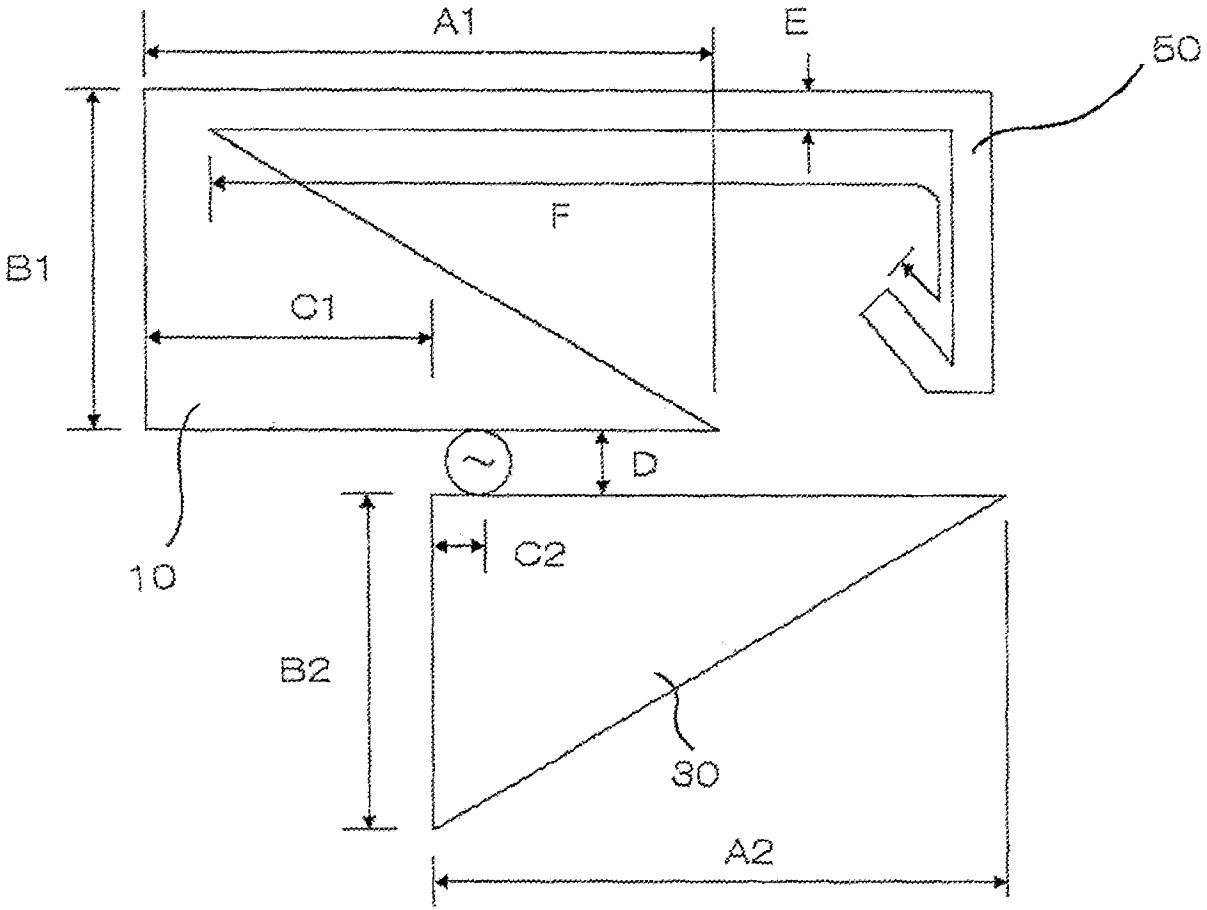
{FIG. 4} A configuration diagram of a wideband antenna according to a second exemplary embodiment of the present invention.

FIG. 4 is a configuration diagram of a wideband antenna according to a second exemplary embodiment of the present invention. In a similar manner to that of FIG. 3, the wideband antenna includes a radiating element 10 having a conductive plate in the shape of a right triangle, a radiating element 30 having a conductive plate in the shape of a right triangle, and a strip-shaped element 50. The difference between the wideband antenna of the second exemplary embodiment and that of FIG. 3 is that the feeding section is shifted to the right in FIG. 4 by an amount equivalent to the length C2 from the right-angled vertex of the radiating element 30. In general, the length C2 is set at around zero to one-tenth of the wavelength of the lower-limit frequency of the high-frequency band.

Third Exemplary Embodiment

Figure 5:
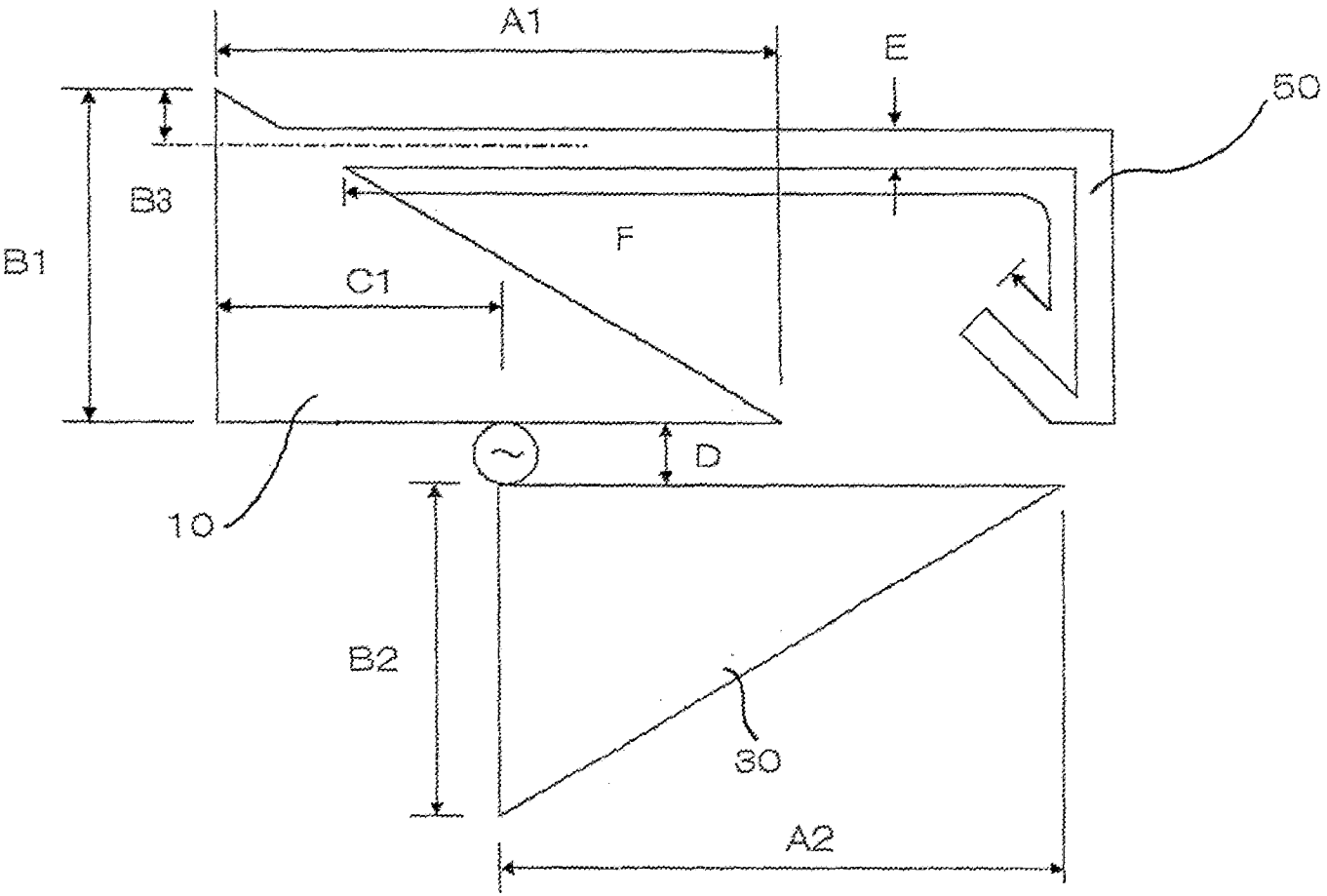
{FIG. 5} A configuration diagram of a wideband antenna according to a third exemplary embodiment of the present invention.

FIG. 5 is a configuration diagram of a wideband antenna according to a third exemplary embodiment of the present invention. In a similar manner to that of FIG. 3, the wideband antenna includes a radiating element 10 having a conductive plate in the shape of a right triangle, a radiating element 30 having a conductive plate in the shape of a right triangle, and a strip-shaped element 50. The difference between the wideband antenna of the third exemplary embodiment and that of FIG. 3 is that the point where the strip-shaped element 50 is connected is positioned slightly lower on the hypotenuse of the radiating element 10. The distance B3 from the upper vertex of the radiating element 10 to a center line of the strip-shaped element 50 has impact on the matching characteristics of, in particular, the low-frequency band. For impedance matching, the connection point is adjusted. When the ratio of the center frequency of the low-frequency band to the lower-limit frequency of the high-frequency band is close to 1:2, i.e. 190 MHz and 400 MHz in one example, good impedance characteristics can be generally obtained by connecting the strip-shaped element 50 to around the upper vertex.

Figure 6:
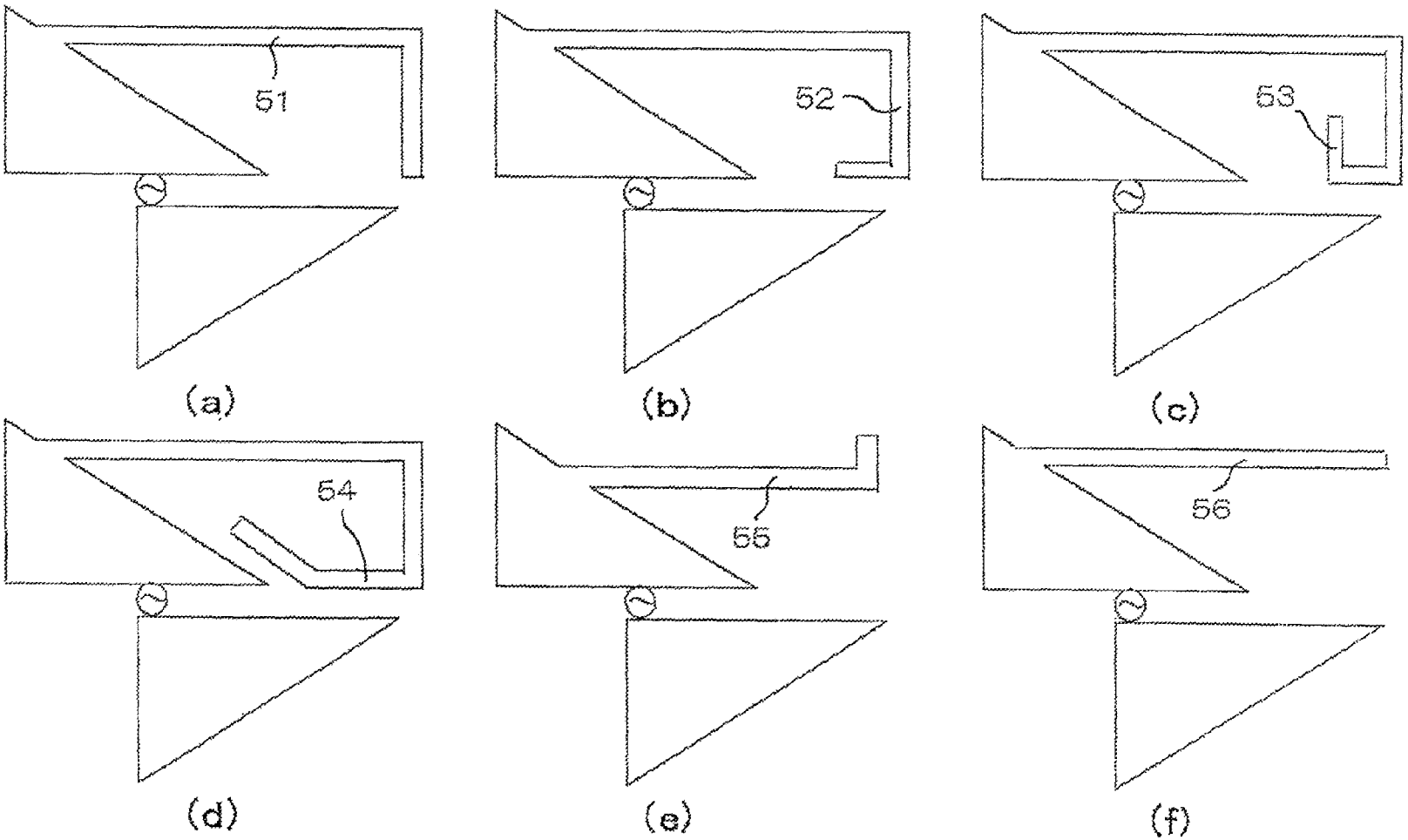
{FIG. 6} A configuration diagram illustrating variations of a strip-shaped element.
Figure 7:
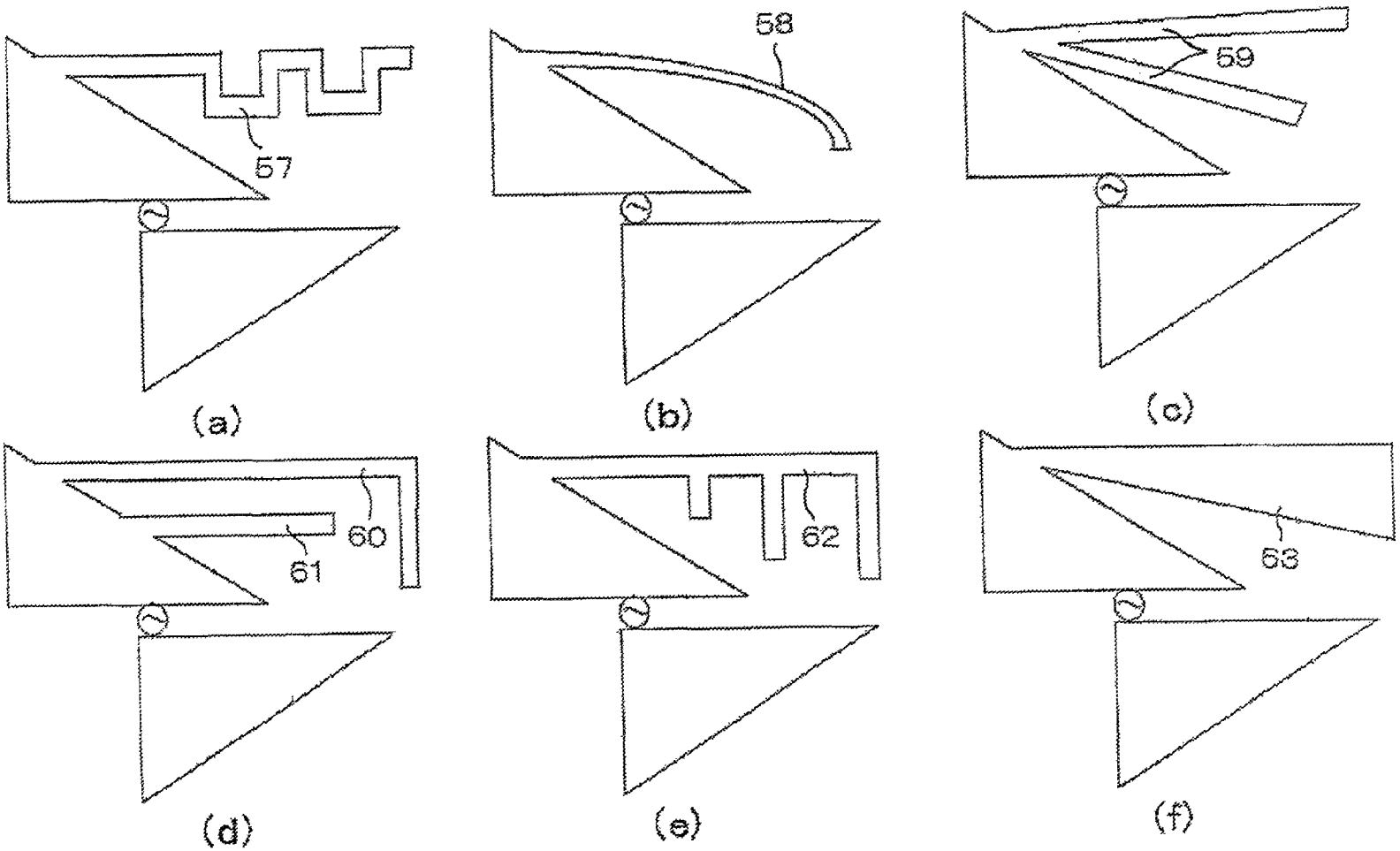
{FIG. 7} A configuration diagram illustrating other variations of the strip-shaped element.

FIGS. 6 and 7 show variations of the strip-shaped element.

FIG. 6(*a*) shows a strip-shaped element 51 in the shape of a "L." As mentioned above, as for the length F of the strip-shaped element, the total length of the inside is set at about one-quarter (¼) of the wavelength of the center frequency of the lower usable frequency. Therefore, if the length turns out to be sufficient due to the frequency to be used, there are no problems with the shape of the strip-shaped element 51, instead of the shape of the strip-shaped element 50 of FIG. 3.

FIG. 6(*b*) shows a strip-shaped element 52 made by making the tip of the strip-shaped element 50 the horizontal. There is no large difference between the strip-shaped elements 52 and 50 in terms of electric characteristics.

FIG. 6(*c*) shows a strip-shaped element 53. The tip of the strip-shaped element 53 is extended upward in the diagram in case the length of the strip-shaped element 52 is insufficient.

FIG. 6(*d*) shows a strip-shaped element 54 produced by making the tip of the strip-shaped element 53 run parallel to the hypotenuse of the radiating element 10. When the frequency to be used is low, the length of the strip-shaped element 54 becomes longer, probably resulting in a structure resembling the strip-shaped element 54. If the tip of the strip-shaped element 54 passes near the radiating element 10, the distance from the radiating element 10 and the interconnection are adjusted and may be used as an adjustment means for impedance matching.

FIG. 6(*e*) shows a strip-shaped element 55 made by bending the tip of the strip-shaped element 51 upward in the diagram.

FIG. 6(*f*) shows a straight strip-shaped element 56. There are no problems with the shape of the strip-shaped element 56 when the frequency to be used is not so low and the length of the strip-shaped element 56 can be one-quarter of the wavelength in the shape of a straight line.

FIG. 7(*a*) shows a strip-shaped element 57 that is in a zigzag or serpentine shape, instead of the shape of a "L" for the strip-shaped elements 51 and 56, to ensure a sufficient length in case the length of the strip-shaped element 56 is insufficient.

FIG. 7(*b*) shows a strip-shaped element 58 formed in the shape of a circular arc, instead of the shape of a "L" for the strip-shaped element 51.

FIG. 7(*c*) shows a strip-shaped element 59 that bifurcates. The two bifurcated strip-shaped elements are usually different in length, enabling the strip-shaped element 59 to be used for two bands in the low-frequency band. That is, in this case, a wideband antenna including the strip-shaped element 59 can be used for three bands, including that of the high-frequency band. In this case, the two bifurcated strip-shaped elements are each set at about one-quarter of the wavelength of the frequencies to be used in length.

In the case of FIG. 7(*c*), the use of the strip-shaped element 59 is also an effective way to use the low-frequency band, which is originally a narrow band, as wide as possible. In this case, since the two bifurcated strip-shaped elements are slightly different in length, the originally narrow band is made about one and a half or two times wider.

FIG. 7(*d*) shows strip-shaped elements 60 and 61: two strip-shaped elements are added in terms of shape. The two additional strip-shaped elements 60 and 61 are available for two bands in the low-frequency band because the strip-shaped elements 60 and 61 are different in length. That is, in this case, a wideband antenna including the strip-shaped elements 60 and 61 can be used for three bands, including that of the high-frequency band. The strip-shaped element 60 is formed in the shape of a "L." In this case, the two additional strip-shaped elements are each set at about one-quarter of the wavelength of the frequencies to be used in length.

FIG. 7(*e*) shows the shape of a strip-shaped element 62: a plurality of additional ramified strip-shaped elements extends from the middle of one strip-shaped element. Even in this case, the ends of a plurality of the ramified strip-shaped elements are different in length, enabling the strip-shaped element 62 to be used for a plurality of frequency bands. In this case, the strip-shaped element 62 can be used for three bands, or four bands if that of the high-frequency band is included. In this case, the three ramified strip-shaped elements are each set at about one-quarter of the wavelength of the frequencies to be used in length.

FIG. 7(*f*) shows the shape of a strip-shaped element 63: the tapered strip-shaped element has a wider tip. Because of the shape of the strip-shaped element 63, in the originally narrow low-frequency band, the band is made slightly wider.

Figure 8:
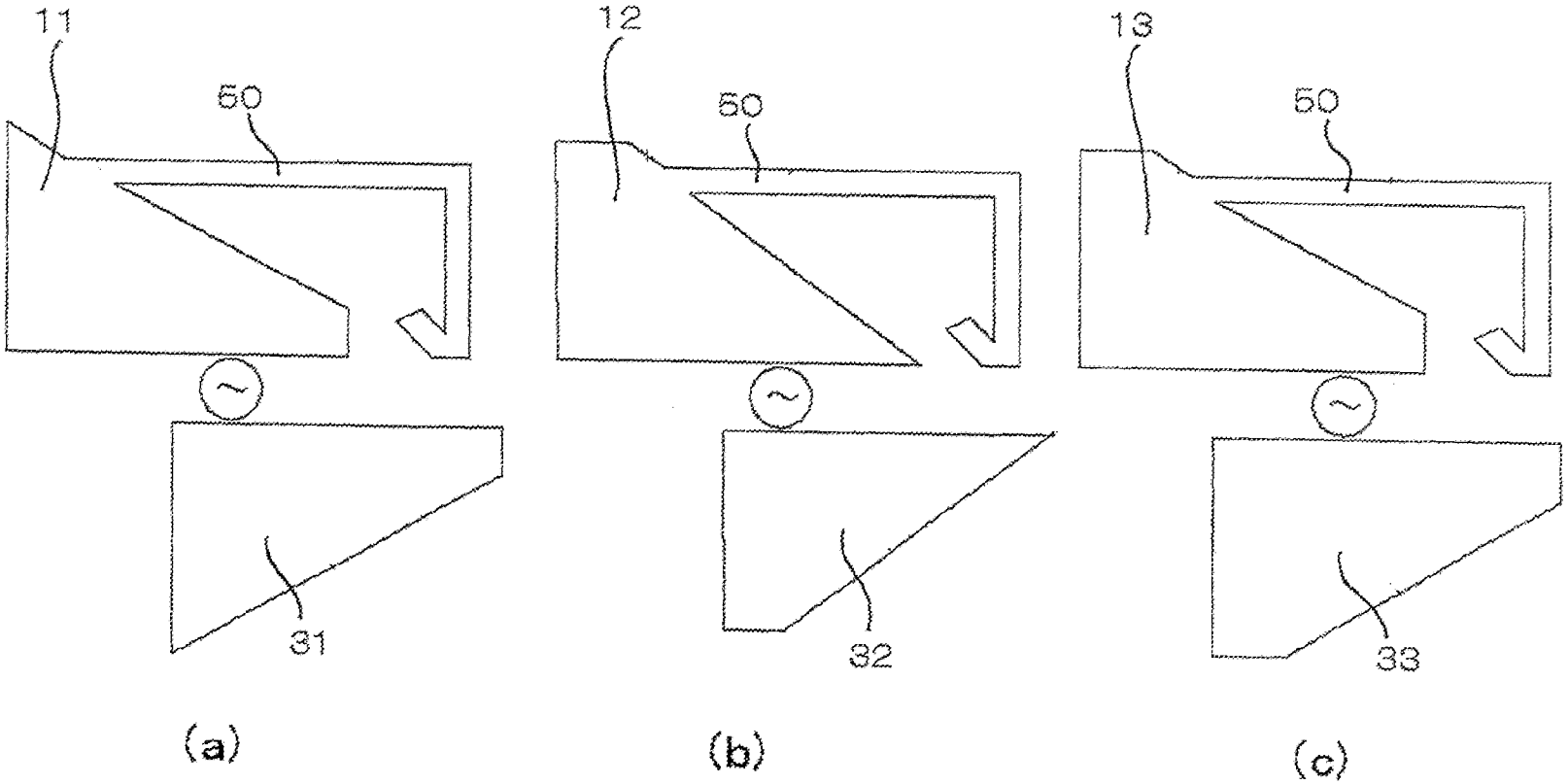
{FIG. 8} A configuration diagram illustrating variations of radiating elements.

FIG. 8 shows variations of the radiating elements.

FIG. 8(*a*) shows a radiating element 11 that is in the shape of a trapezoid or quadrilateral, compared with the radiating element 10 of FIG. 5: the tip of the radiating element 11, which includes the right-hand vertex of the right triangle, is cut off. A radiating element 31 is also formed in the shape of a trapezoid or quadrilateral, compared with the radiating element 30 of FIG. 5: the tip of the radiating element 31, which includes the right-hand vertex of the right triangle, is cut off. The radiating element 11 or 31 that lacks the right-hand tip of the right triangle does not have a large impact on performance as a whole if the cut-off portion is small.

FIG. 8(*b*) shows a radiating element 12 that is in the shape of a trapezoid or quadrilateral, compared with the radiating element 10 of FIG. 5: the tip of the radiating element 12, which includes the upper vertex of the right triangle, is cut off. A radiating element 32 is also formed in the shape of a trapezoid or quadrilateral, compared with the radiating element 30 of FIG. 5: the tip of the radiating element 32, which includes the lower vertex of the right triangle, is cut off. The radiating element 12 or 32 that lacks the upper or lower tip of the right triangle does not have a large impact on performance as a whole if the cut-off portion is small.

FIG. 8(*c*) shows a radiating element 13 that is in the shape of a pentagon, compared with the radiating element 10 of FIG. 5: the tips of the radiating element 13, which include the right-hand and upper vertexes of the right triangle, are cut off. A radiating element 33 is also formed in the shape of a pentagon, compared with the radiating element 30 of FIG. 5: the tips of the radiating element 33, which include the right-hand and lower vertexes of the right triangle, are cut off. The radiating element 13 or 33 that lacks the right-hand and upper or the right-hand and lower tips of the right triangle does not have a large impact on performance as 10, a whole if the cut-off portions are small.

Fourth Exemplary Embodiment

Figure 9:
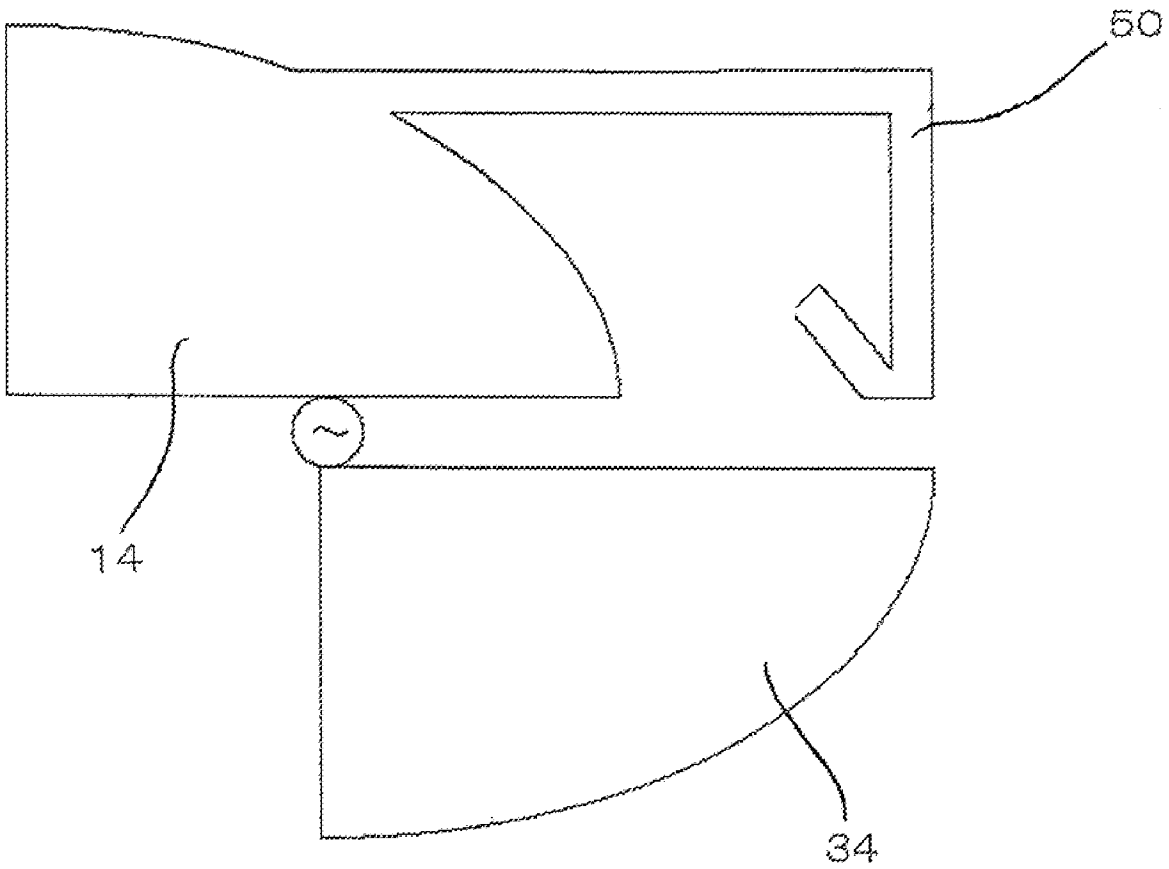
{FIG. 9} A configuration diagram of a wideband antenna according to a fourth exemplary embodiment of the present invention.

FIG. 9 is a configuration diagram of a wideband antenna according to a fourth exemplary embodiment of the present invention. The difference in configuration between the wideband antenna of the fourth exemplary embodiment and that of FIG. 3 is that while the hypotenuses of the radiating elements 10 and 30 that are in the shape of a right triangle are straight as shown in FIG. 3, the hypotenuses are replaced with curved sides in the case of FIG. 9. In FIG. 9, the radiating elements are substantially in the shape of one-quarter of an ellipse. However, the radiating elements may take other curved lines. The radiating elements may be in the shape of a half circle or substantially in the shape of one-half of an ellipse. In this manner, according to the present application, "side" includes a curved line as well as a straight line. Incidentally, those "substantially in the shape of one-quarter of an ellipse" or "substantially in the shape of one-half of an ellipse" include those whose shape is close to one-quarter or one-half of an ellipse that have similar effects to those in the shape of one-quarter or one-half of an ellipse do. For example, those "substantially in the shape of one-quarter of an ellipse" or "substantially in the shape of one-half of an ellipse" include a polygon whose shape is close to an ellipse and a shape having a curved line of an ellipse a portion of which is replaced with a straight line.

In the case of the plate-like wideband antenna, since the deformed portions are away from other elements and conductors, the deformed portions do not have an impact on each other. Even if the shape of the plate-like portion is slightly deformed, the deformation does not seriously affect the characteristics.

Fifth Exemplary Embodiment

Figure 10:
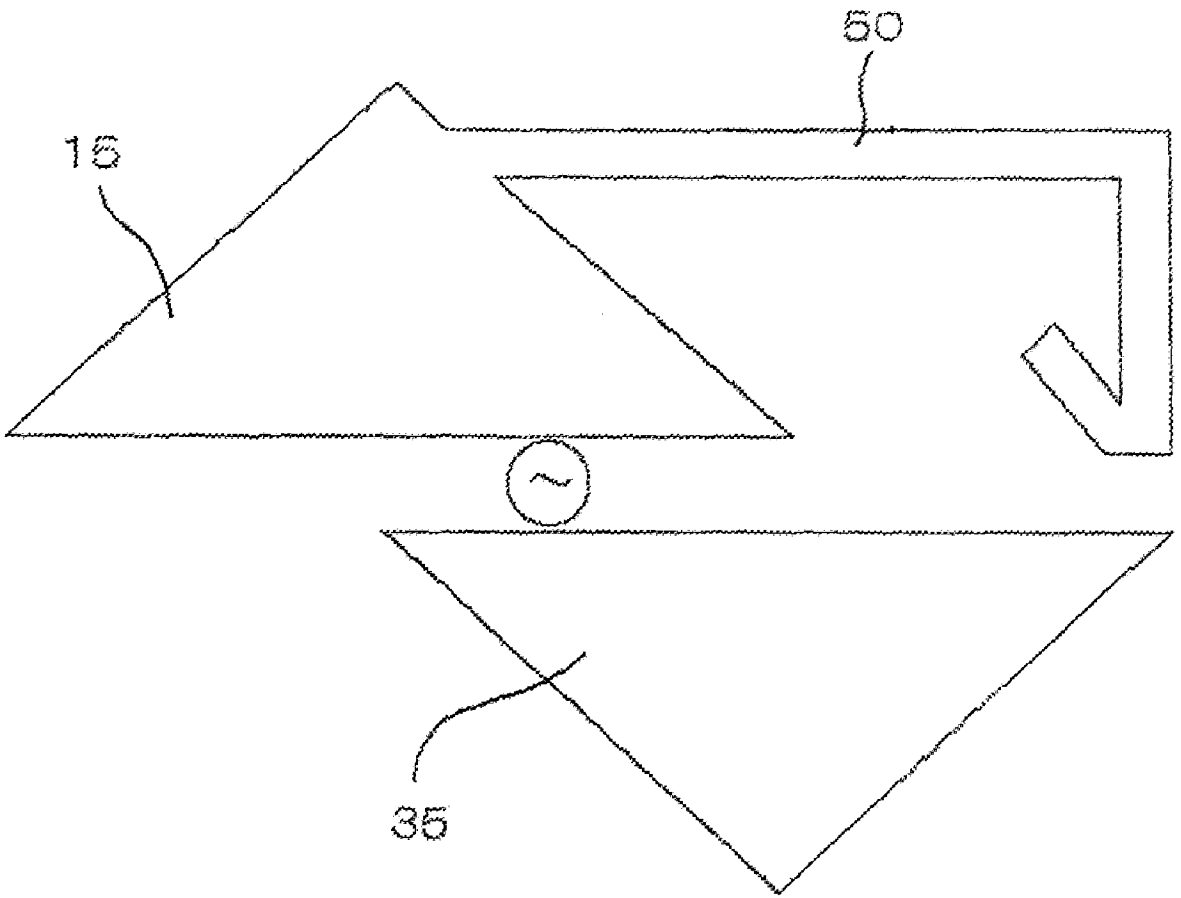
{FIG. 10} A configuration diagram of a wideband antenna according to a fifth exemplary embodiment of the present invention.

FIG. 10 is a configuration diagram of a wideband antenna according to a fifth exemplary embodiment of the present invention. The difference between the wideband antenna of the fifth exemplary embodiment and that of FIG. 3 is that a simple triangle is used, compared with the radiating elements 10 and 30 that are in the shape of a right triangle as shown in FIG. 3. According to the present configuration, the base of a radiating element 15 and the upper side of a radiating element 35 are required to be substantially parallel to each other after being arranged. However, the radiating elements 15 and 35 may not be in the shape of a right triangle. As long as the shape is close to a triangle, similar effects to those of the wideband antenna of FIG. 10 can be obtained: the radiating elements 15 and 35 may be in the shape of a polygon whose shape is close to a triangle with four or more corners. According to the present application, those "substantially in the shape of a triangle" include those whose shape is close to a triangle. It is desirable that the shape of those "substantially in the shape of a triangle" be close to a right triangle. In particular, it is desirable that the right-angled portion of the right triangle have an angle of about 90 degrees±10% and the portion corresponding to the hypotenuse is a broken curve; such a shape is referred to as being "substantially in the shape of a right triangle," according to the present application.

Sixth Exemplary Embodiment

Figure 11:
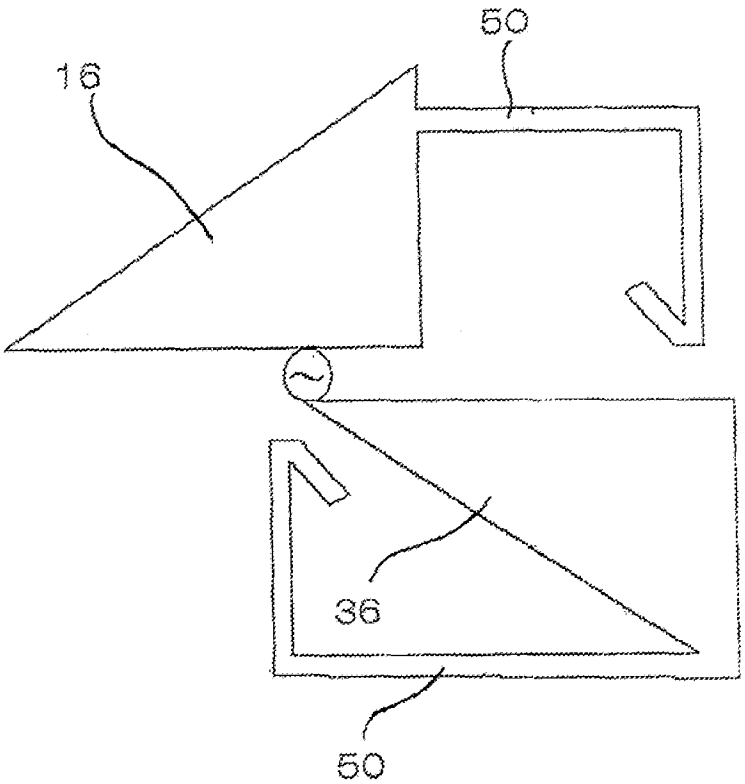
{FIG. 11} A configuration diagram of a wideband antenna according to a sixth exemplary embodiment of the present invention.
Figure 11:
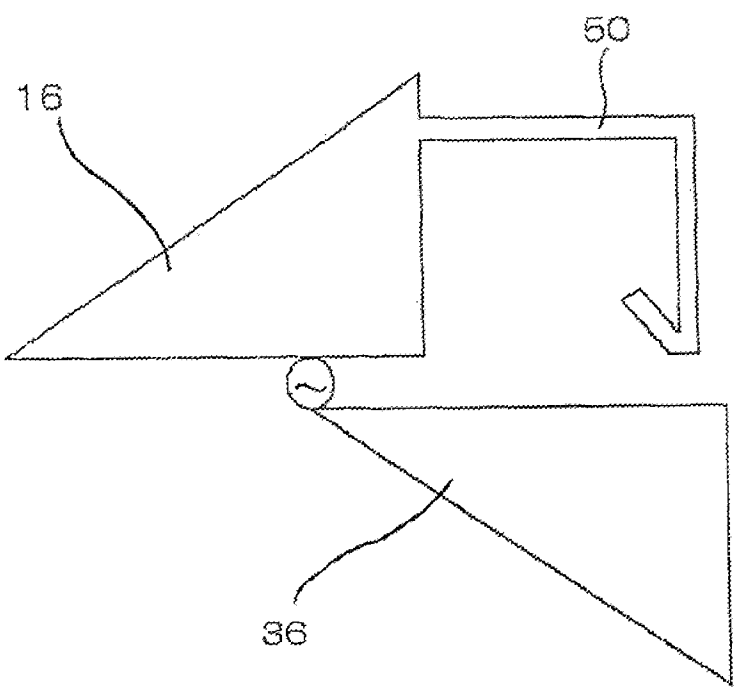

FIG. 11 is a configuration diagram of a wideband antenna according to a sixth exemplary embodiment of the present invention. The difference between the wideband antenna of FIG. 11(*a*) and that of FIG. 3 is that radiating elements 16 and 36 are made by inverting the radiating elements 10 and 30, which are in the shape of a right triangle as shown in FIG. 3, left to right, and that the strip-shaped element 50 connects to the vertical side of the radiating element 16, not the hypotenuse. However, there is no large difference between the configuration of FIG. 11(*a*) and the configuration of FIG. 3 in terms of electrical characteristics. First, as for the high-frequency band, it is only the radiating elements 16 and 36 that are flipped left to right; there are no differences in terms of impedance matching and wideband performance. As for the connection point of the strip-shaped element 50, although FIG. 11(*a*) and FIG. 3 are different in that the strip-shaped element 50 is connected to the vertical side of the radiating element 16, not the hypotenuse, there is no significant differences because the strip-shaped element 50 is connected to around the upper tip of the radiating element 16. There are no significant differences between the configuration of FIG. 11(*a*) and the configuration of FIG. 3 in terms of electrical characteristics because the strip-shaped element 50 is originally designed to cover only a narrow band, the current distribution exists mainly on the strip-shaped element 50, and the radiating element 16 merely serves as a passage to the strip-shaped element 50.

FIG. 11(*b*) shows the one whose another strip-shaped element 50 is added to the hypotenuse of the lower radiating element 36.

Seventh Exemplary Embodiment

Figure 12:
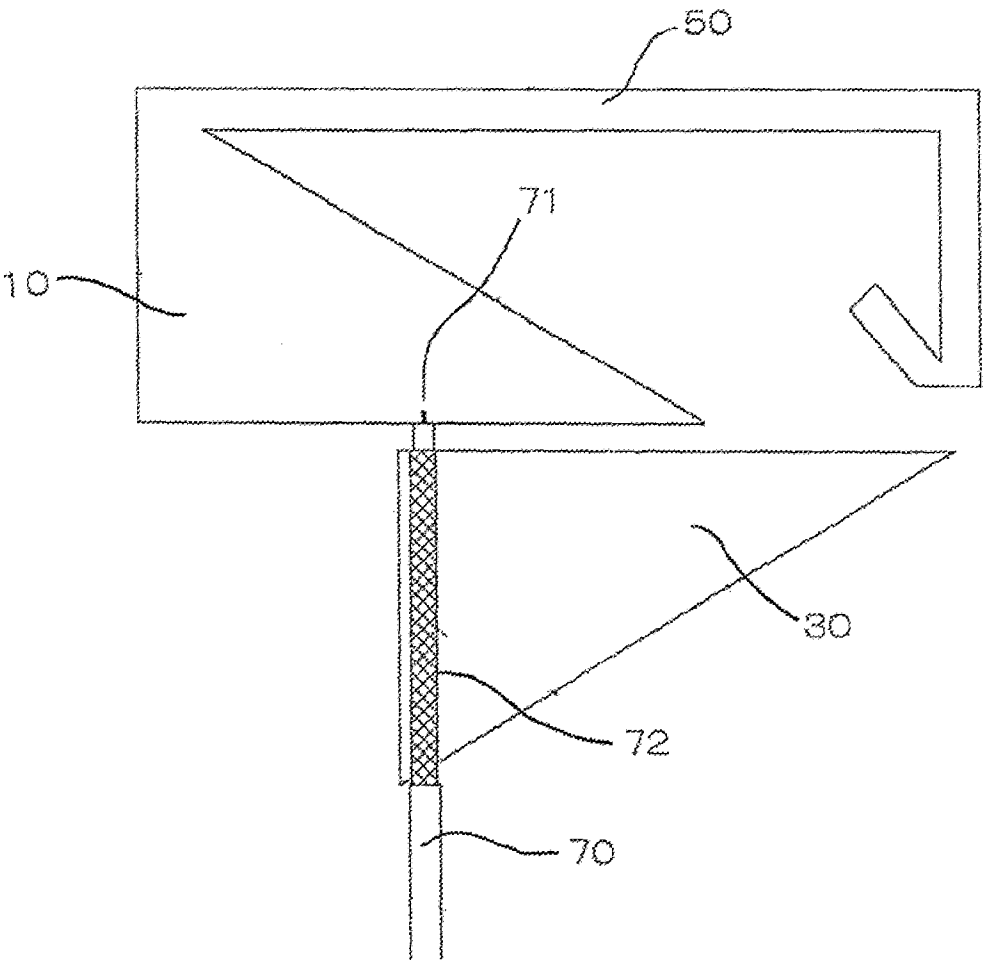
{FIG. 12} A configuration diagram of a wideband antenna according to a seventh exemplary embodiment of the present invention.

FIG. 12 is a configuration diagram of a wideband antenna according to a seventh exemplary embodiment of the present invention, showing an example of using a coaxial cable 70 for feeding electricity with the configuration of FIG. 3. A coaxial center conductor 71 of the coaxial cable 70 is connected to the radiating element 10, and a coaxial external conductor 72 to the radiating element 30. Soldering or the like is applied for connection.

Eighth Exemplary Embodiment

Figure 13:
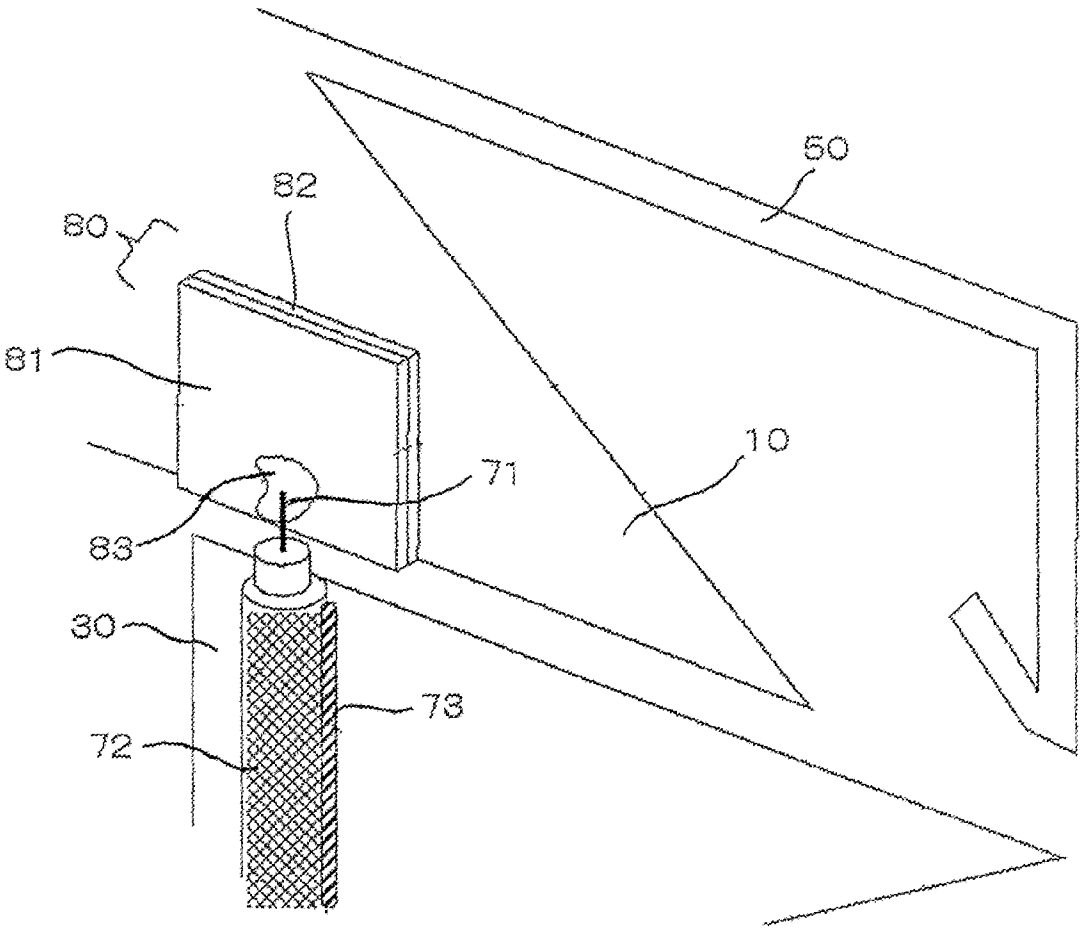
{FIG. 13} A configuration diagram of a wideband antenna according to an eighth exemplary embodiment of the present invention.

FIG. 13 is a configuration diagram of a wideband antenna according to an eighth exemplary embodiment of the present invention: as for the connection of the coaxial center conductor 71 of the coaxial cable 70, a power feeding section 80 is used for connection, with the configuration of FIG. 12. The power feeding section 80 includes a power feeding conductor (conductor section) 81 and an insulating section (insulator) 82. The coaxial center conductor 71 is once connected to the power feeding conductor 81 made of a conductor with solder 83 or the like. The power feeding conductor 81 and the insulating section 82 are firmly bonded together; the insulating section 82 is firmly bonded to the radiating element 10. Accordingly, there is capacitance between the power feeding conductor 81 and the radiating element 10 through the insulating section 82; in terms of high frequencies, electricity is fed because of electrostatic coupling.

The power feeding conductor 81 and the insulating section 82 can be made by combining a metal plate and a dielectric such as plastics. However, typical ways of making the power feeding conductor 81 and the insulating section 82 include etching a printed board or a flexible printed circuit board (Flexible Printed Circuits) called FPC. The coaxial external, conductor 72 is connected to the radiating element 30 with solder 73 or the like.

Ninth Exemplary Embodiment

Figure 14:
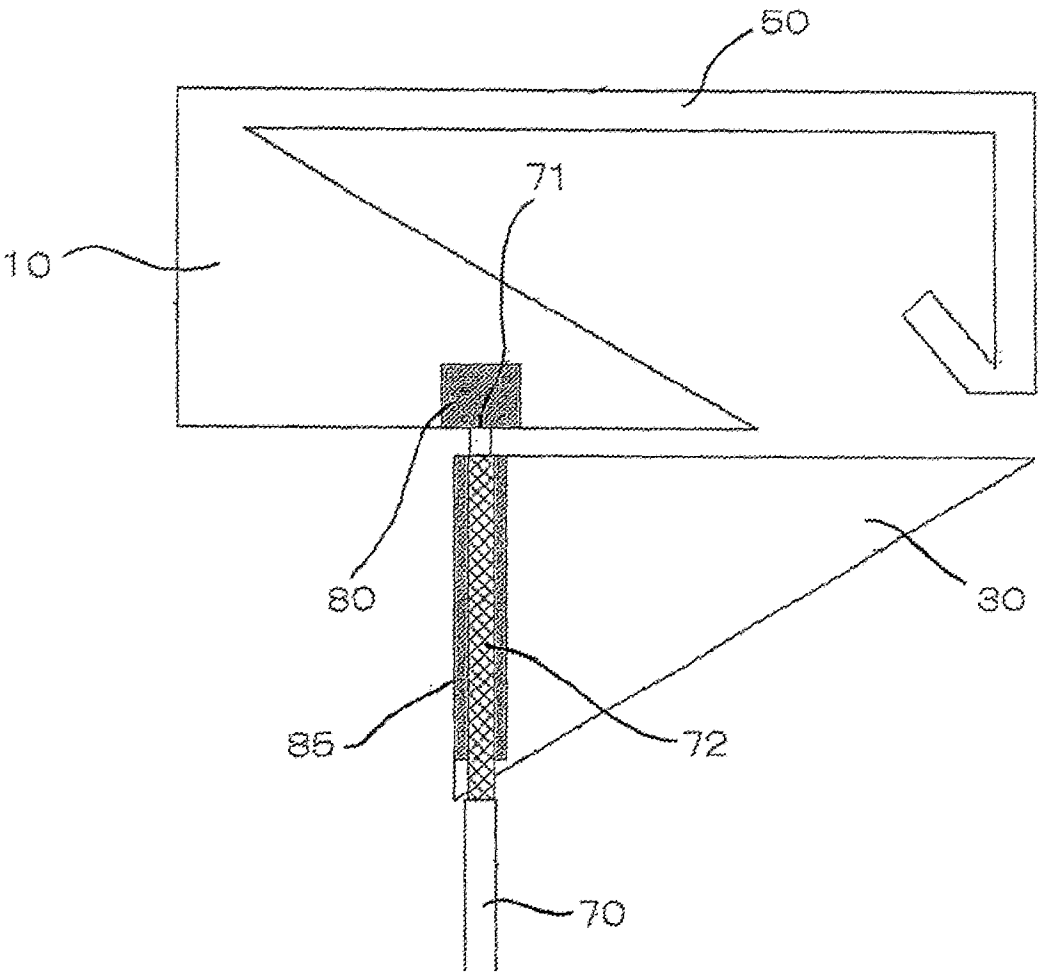
{FIG. 14} A configuration diagram of a wideband antenna according to a ninth exemplary embodiment of the present invention.

FIG. 14 is a configuration diagram of a wideband antenna according to a ninth exemplary embodiment of the present invention. The difference between the configuration of FIG. 13 and the configuration of FIG. 14 is that as for the connection of the coaxial external conductor 72 of the coaxial cable 70, a power feeding section 85 is used for connection.

Figure 15:
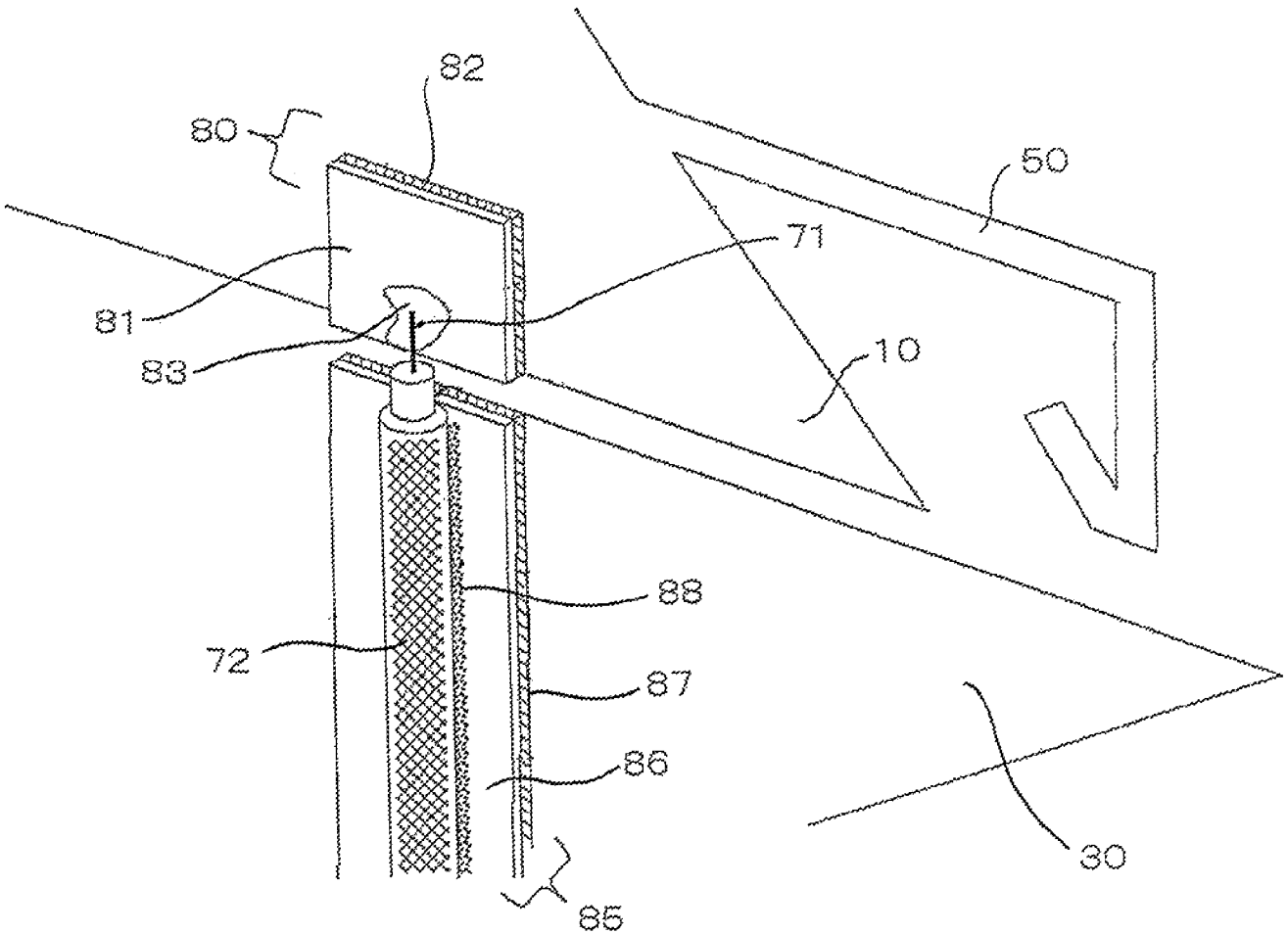
{FIG. 15} A detail view of a power feeding section according to the ninth embodiment of the present invention.

FIG. 15 is a detail view of the power feeding section according to the ninth exemplary embodiment of FIG. 14. The power feeding section 85 includes a power feeding conductor 86 and an insulating section (insulator) 87. The coaxial external conductor 72 is once connected to the power feeding conductor 86 made of a conductor with solder 88 or the like. The power feeding conductor 86 and the insulating section 87 are firmly bonded together; the insulating section 87 is firmly bonded to the radiating element 30. Accordingly, there is capacitance between the power feeding conductor 86 and the radiating element 30 through the insulating section 87; in terms of high frequencies, electricity is fed because of electrostatic coupling.

As in the eighth embodiment, the power feeding conductor 86 and the insulating section 87 can be made by combining a metal plate and a dielectric such as plastics. However, typical ways of making the power feeding conductor 86 and the insulating section 87 include etching a printed board or a flexible printed circuit board (Flexible Printed Circuits) called FPC.

In the cases of FIGS. 13 to 15, the insulating sections 82 and 87 are desired to be made of a sufficiently thin material, and the capacitance between the power feeding conductors 81 and 86 and the radiating elements 10 and 30 is desired to be large with the value thereof representing sufficiently lower reactance for the usable frequency. By the way, it is possible to adjust impedance matching for the feeding of electricity to the radiating elements 10 and 30 by making adjustments to the capacitance by adjusting the thicknesses of the insulating sections 82 and 87 and the areas of the power feeding conductors 81 and 86. Similar effects can be obtained even when the insulating sections 82 and 87 are made of a different material having an appropriate permittivity.

Other ways of connecting the power feeding conductors, the insulating sections and the radiating elements may involve the use of adhesives, thermal fusion bonding or the like. When the power feeding conductors and the insulating sections are made with a printed board, the printed board may be connected to the radiating elements with adhesives, screws, or clips or through thermal fusion bonding or swaging in an effective manner.

A method of making the power feeding conductors, the insulating sections and the radiating elements with a three-layer printed board is also effective.

Tenth Exemplary Embodiment

Figure 16:
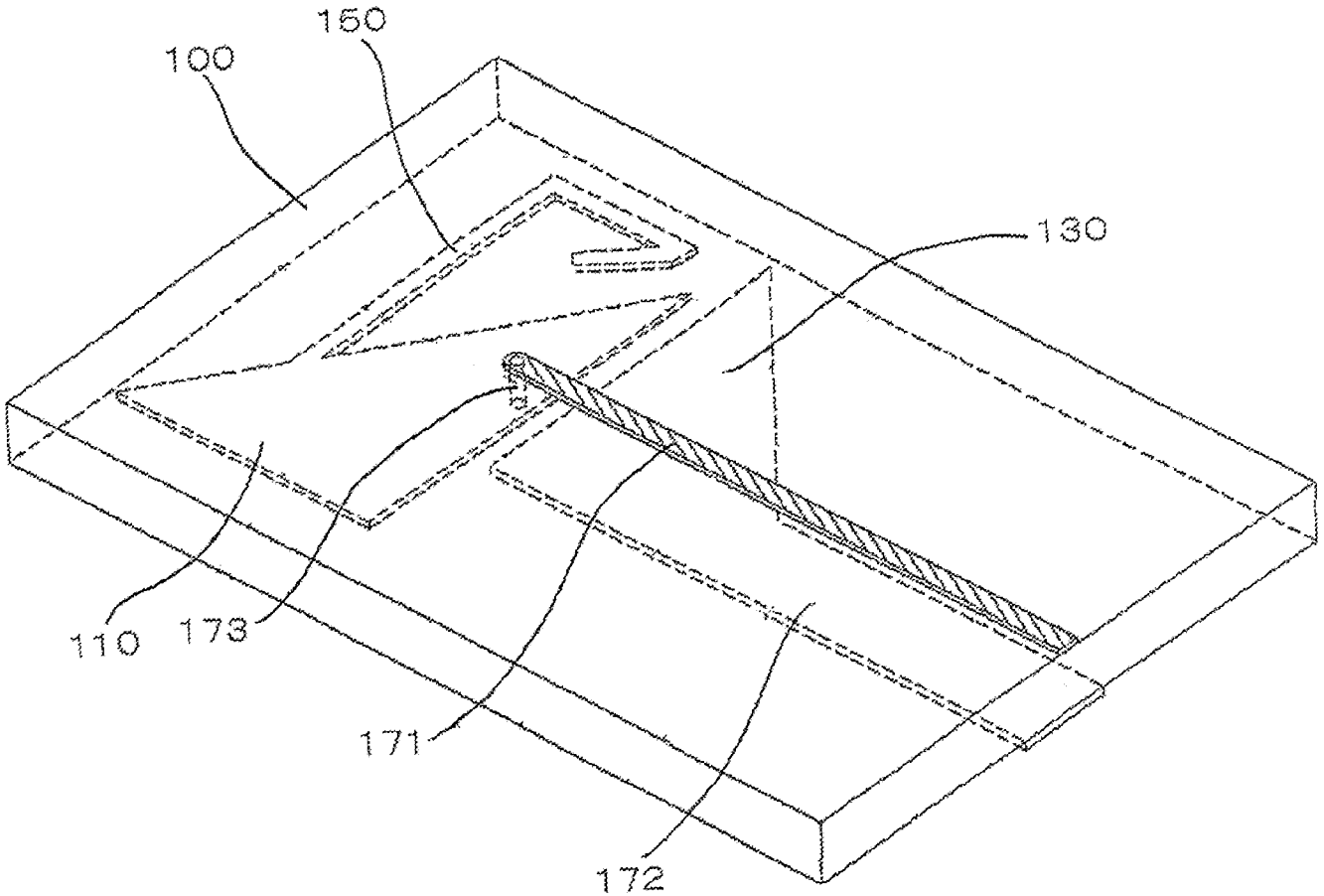
{FIG. 16} A configuration diagram of a wideband antenna according to a tenth exemplary embodiment of the present invention.

FIG. 16 is a configuration diagram of a wideband antenna according to a tenth exemplary embodiment of the present invention: the antenna of FIG. 5 is made with a double-sided printed board 100. Such materials as Teflon, FR-4 (glass epoxy), BT resin and PPE are often used for the printed board. On the under surface of the printed board 100, radiating elements 110 and 130 and a strip-shaped element 150 that are similar to those of FIG. 5 are formed as a conductive pattern by etching. Electricity is fed by a microstrip line 171 (serving as a power feeder) etched on the top surface via a through hole 173. A ground 172, along with the microstrip line 171, makes up a microstrip line.

Eleventh Exemplary Embodiment

Figure 17:
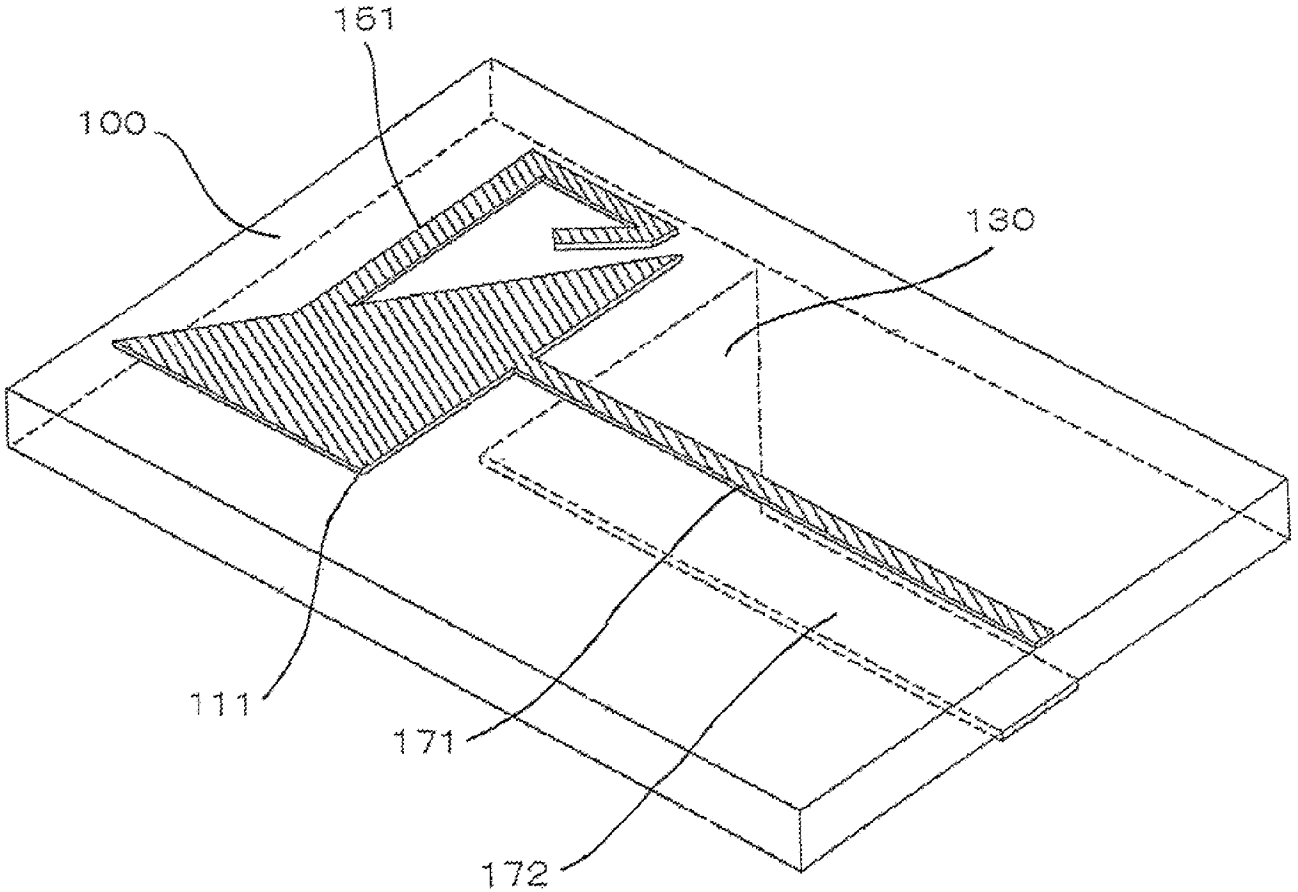
{FIG. 17} A configuration diagram of a wideband antenna according to an eleventh exemplary embodiment of the present invention.

FIG. 17 is a configuration diagram of a wideband antenna according to an eleventh exemplary embodiment of the present invention. The difference between the configuration of FIG. 17 and that of FIG. 16 is that a radiating element 111 and a strip-shaped element 151 are disposed on the top surface of the printed board 100, directly connected to the microstrip line 171, a power feeder, and fed electricity. The ground 172, along with the microstrip line 171, makes up a microstrip line.

Twelfth Exemplary Embodiment

Figure 18:
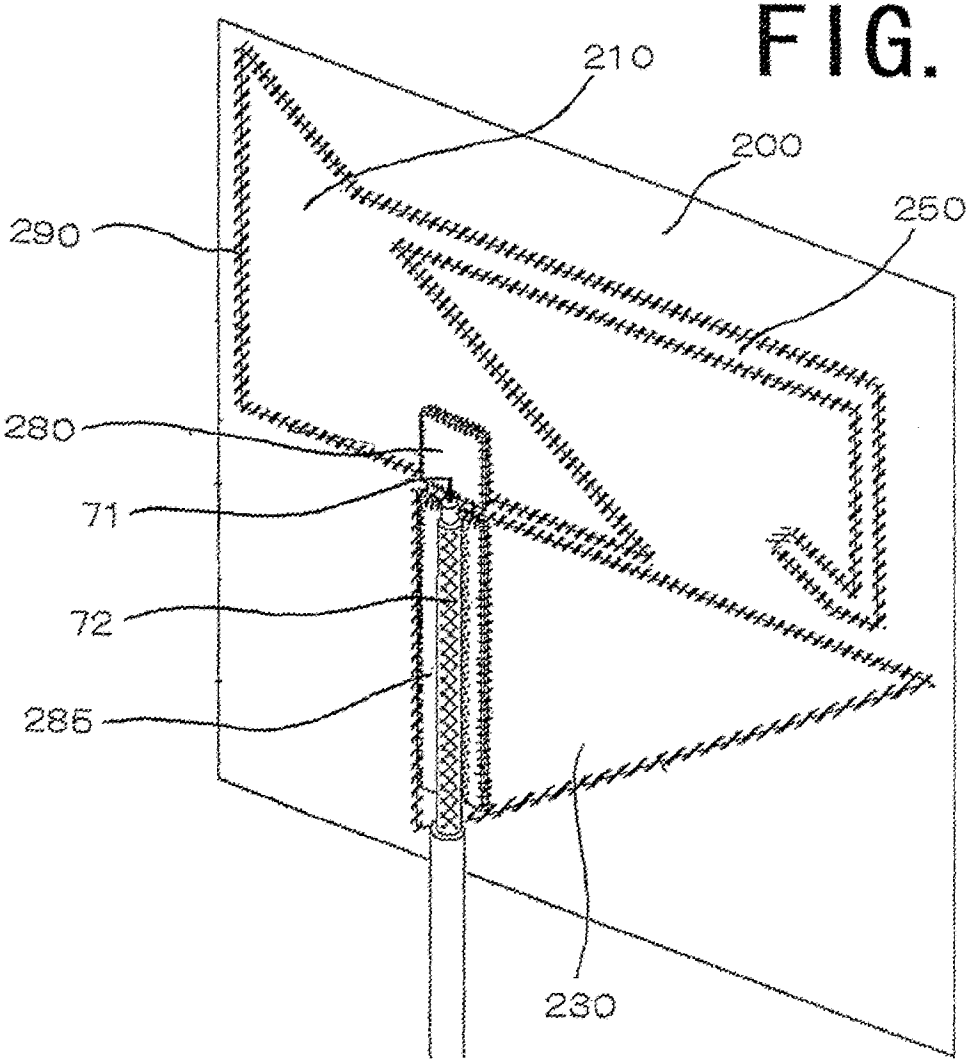
{FIG. 18} A configuration diagram of a wideband antenna according to a twelfth exemplary embodiment of the present invention.

FIG. 18 is a configuration diagram of a wideband antenna according to a twelfth exemplary embodiment of the present invention. A base 200 is made of a flexible material that can be bent, such as fabric. Radiating elements 210 and 230 and a strip-shaped element 250 are sewed to the surface of the base 200 with thread 290: the radiating elements 210 and 230 and the strip-shaped element 250 are made of conductive fabric, flexible printed boards that can be bent, or the like. Electricity is fed by a coaxial cable to the radiating elements 210 and 230 through power feeding sections 280 and 285.

Figure 19:
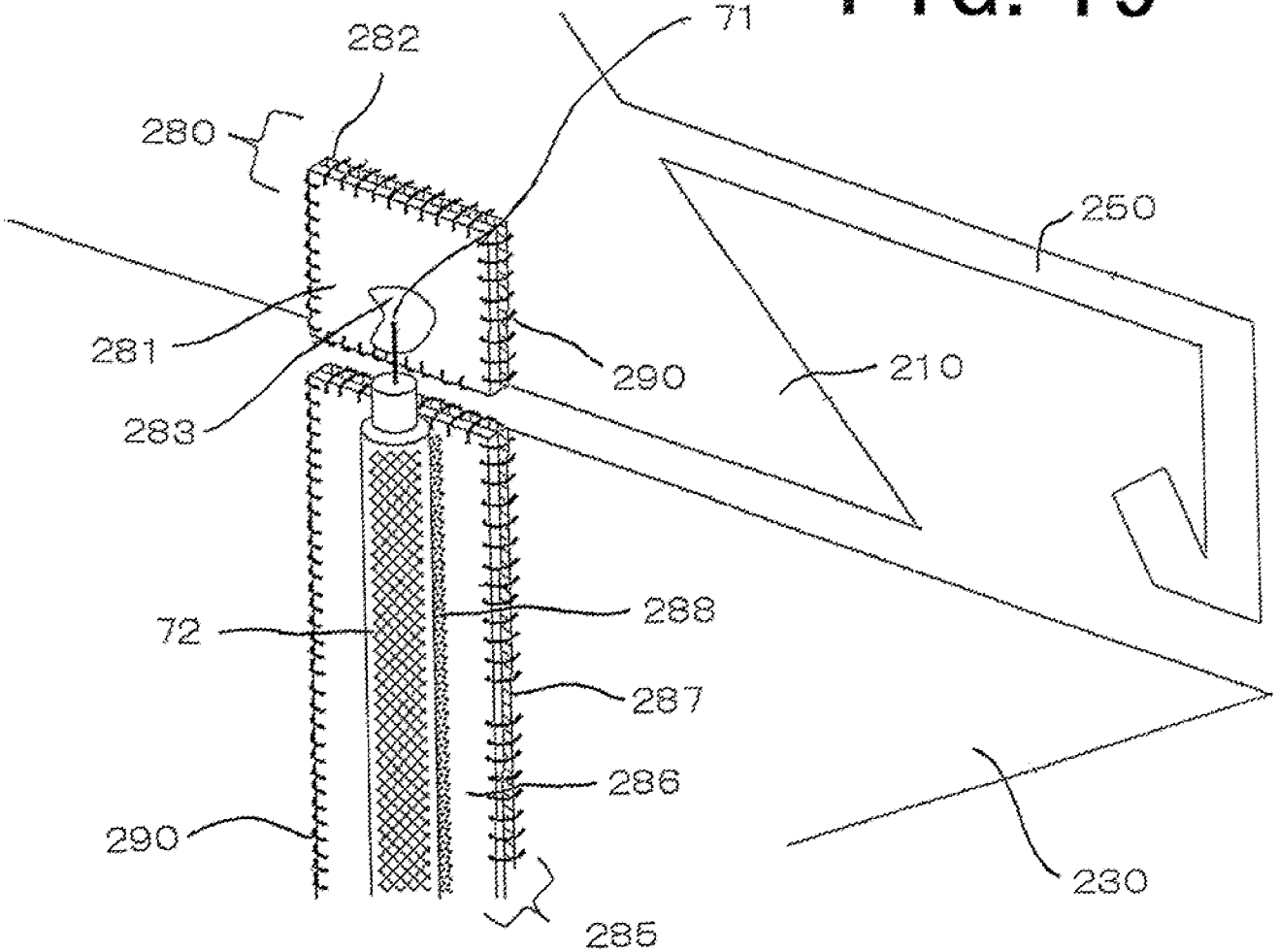
{FIG. 19} A detail view of a power feeding section according to the twelfth embodiment.

FIG. 19 is a detail view of the power feeding sections according to the twelfth embodiment of FIG. 18. The power feeding section 280 includes a power feeding conductor 281 and an insulating section 282. The coaxial center conductor 71 is once connected to the power feeding conductor 281 made of a conductor with solder 283 or the like. The power feeding conductor 281 and the insulating section 282 are firmly bonded together; the insulating section 282 is firmly bonded to the radiating element 210. Accordingly, there is capacitance between the power feeding conductor 281 and the radiating element 210 through the insulating section 282; in terms of high frequencies, electricity is fed because of electrostatic coupling.

Similarly, the power feeding section 285 includes a power feeding conductor 286 and an insulating section 287. The coaxial external conductor 72 is once connected to the power feeding conductor 286 made of a conductor with solder 288 or the like. The power feeding conductor 286 and the insulating section 287 are firmly bonded together; the insulating section 287 is firmly bonded to the radiating element 230. Accordingly, there is capacitance between the power feeding conductor 286 and the radiating element 230 through the insulating section 287; in terms of high frequencies, electricity is fed because of electrostatic coupling.

The radiating elements 210 and 230, which are connected to the power feeding conductors 281 and 286 and the insulating sections 282 and 287, are made of a conductive fabric that can be bent. Therefore, the power feeding conductors and insulating sections made with a material that can be bent are easier to use. Accordingly, the power feeding conductors and the insulating sections are made by etching a flexible printed circuit board (Flexible Printed Circuits) called FPC.

The power feeding conductor 281 and the insulating section 282 are sewed to the radiating element 210 with thread 290, and the power feeding conductor 286 and the insulating section 287 are sewed to the radiating element 230. Since there is no need for electrical (direct-current) conduction to exist between the power feeding conductors 281 and 286 and the radiating elements 210 and 230, the thread used need not be conductive and may be an ordinary thread.

A way of feeding electricity with the use of a coaxial cable is the same as those described above with reference to FIGS. 13 to 15.

Incidentally, for the power feeding sections 280 and 285, an easy way is to use FPC. However, if there is a conductive fabric able to be soldered, the configuration of FIG. 12 is also available; a conductive fabric that can be soldered and an insulator may be used for the configuration of FIG. 19.

The power feeding sections 280 and 285 are small components. Therefore, the power feeding sections 280 and 285 may be made with a printed board or the like if the power feeding sections 280 and 285 are not bent when in use. The power feeding sections 280 and 285 may be connected to the radiating elements 210 and 230 with adhesives, screws or Magic Tape (Registered Trademark) or through swaging in an effective manner.

Thirteenth Exemplary Embodiment

Figure 20:
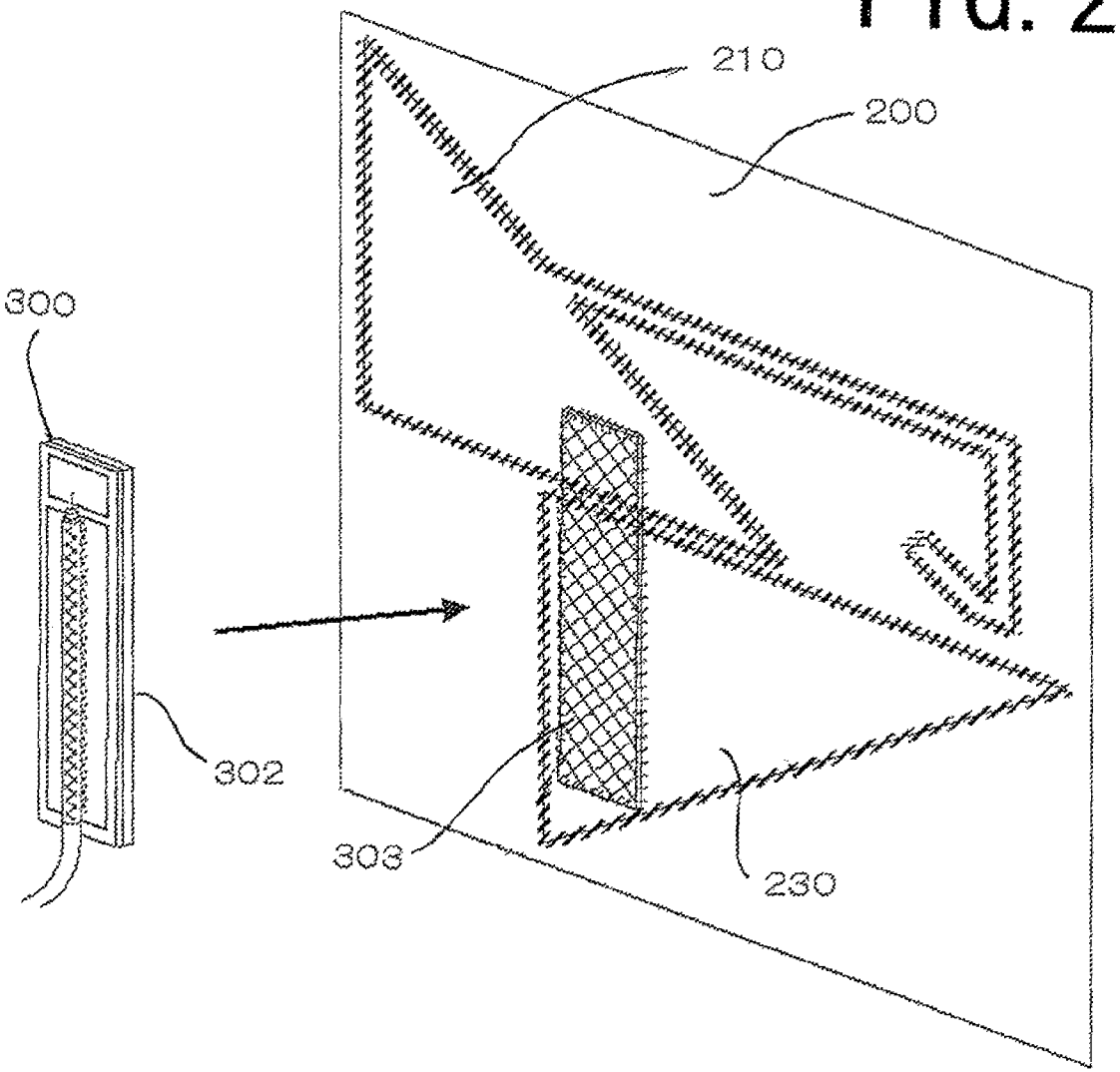
{FIG. 20} A configuration diagram of a wideband antenna according to a thirteenth exemplary embodiment of the present invention.

FIG. 20 is a configuration diagram of a wideband antenna according to a thirteenth exemplary embodiment of the present invention. The difference between the configuration of FIG. 20 and that of FIGS. 18 and 19 is that the power feeding sections 280 and 285 are replaced with a power feeding unit 300.

Magic Tape (Registered Trademark) 302 is bonded to the underside of the power feeding unit 300 and adheres closely to a magic tape 303 that is bonded to the original power-feeding point of the radiating elements 210 and 230.

Figure 21:
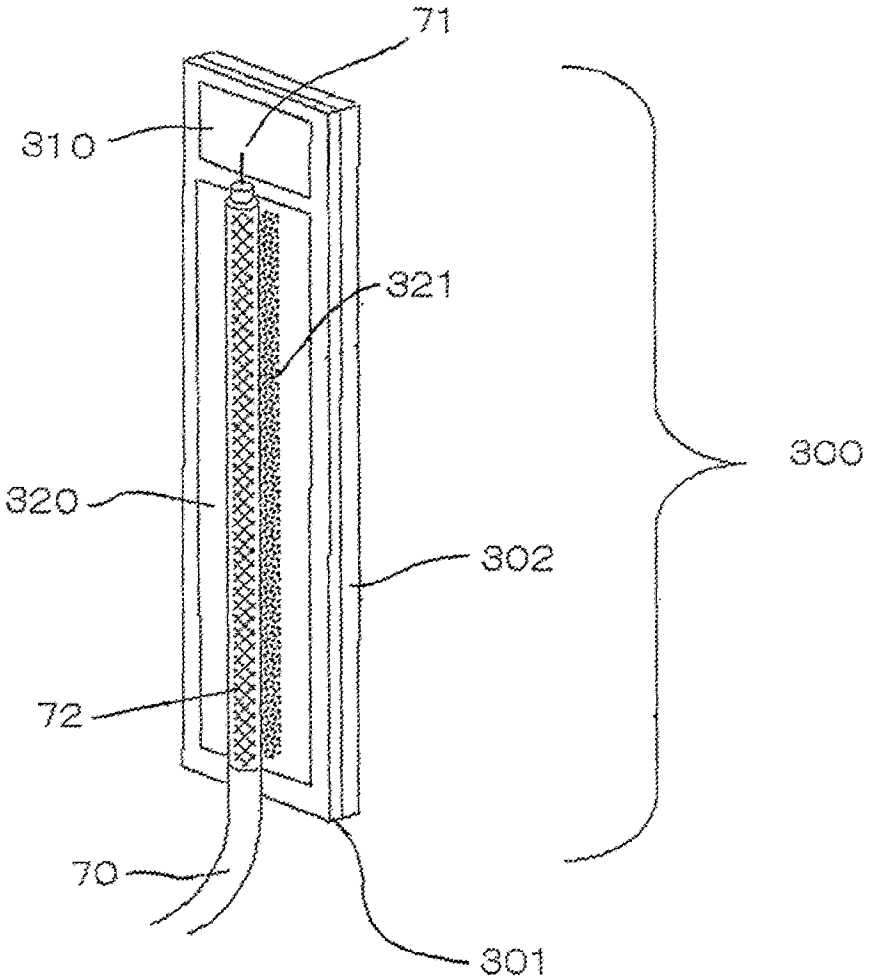
{FIG. 21} A detail view of a power feeding unit according to the thirteenth embodiment.

FIG. 21 is a detail view of the power feeding unit according to the thirteenth embodiment of FIG. 20. The power feeding unit 300 includes a printed board 301, the magic tape 302 and the coaxial cable 70. Power feeding conductors 310 and 320 made of a conductor (usually copper foil) are etched on the surface of the printed board 301 and are soldered to the coaxial center conductor 71 and the coaxial external conductor 72, respectively.

The power feeding unit 300 is firmly attached and mounted by the magic tapes 302 and 303. Therefore, the power feeding conductors 310 and 320 are electrostatically coupled to the radiating elements 210 and 230, respectively and electricity is fed.

Fourteenth Exemplary Embodiment

Figure 22:
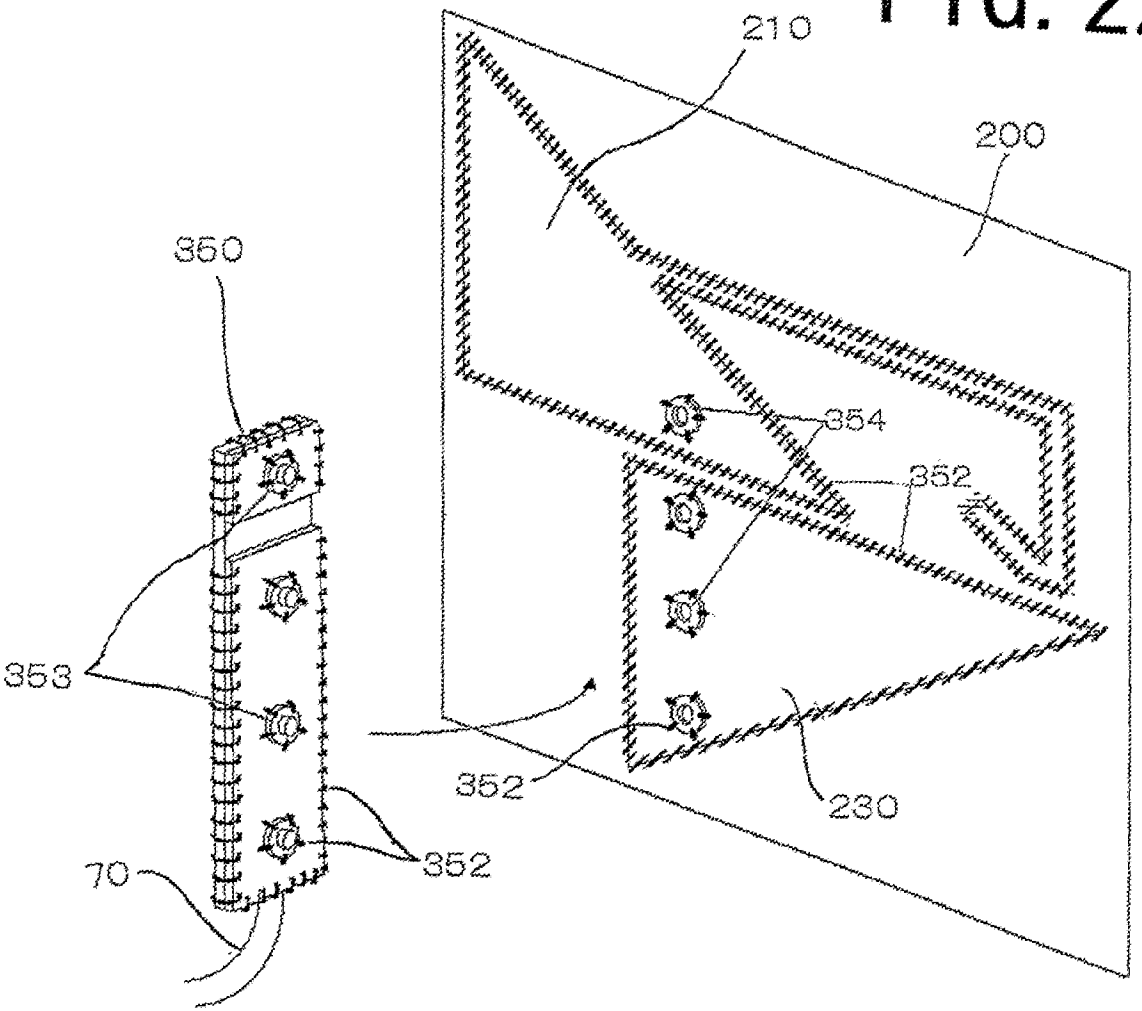
{FIG. 22} A configuration diagram of a wideband antenna according to a fourteenth exemplary embodiment of the present invention.

FIG. 22 is a configuration diagram of a wideband antenna according to a fourteenth exemplary embodiment of the present invention. The difference between the configuration of FIG. 22 and that of FIGS. 20 and 21 is that a power feeding unit 350 has a different structure and is mounted with buttons 353 and 354, not with Magic Tape (Registered Trademark).

Figure 23:
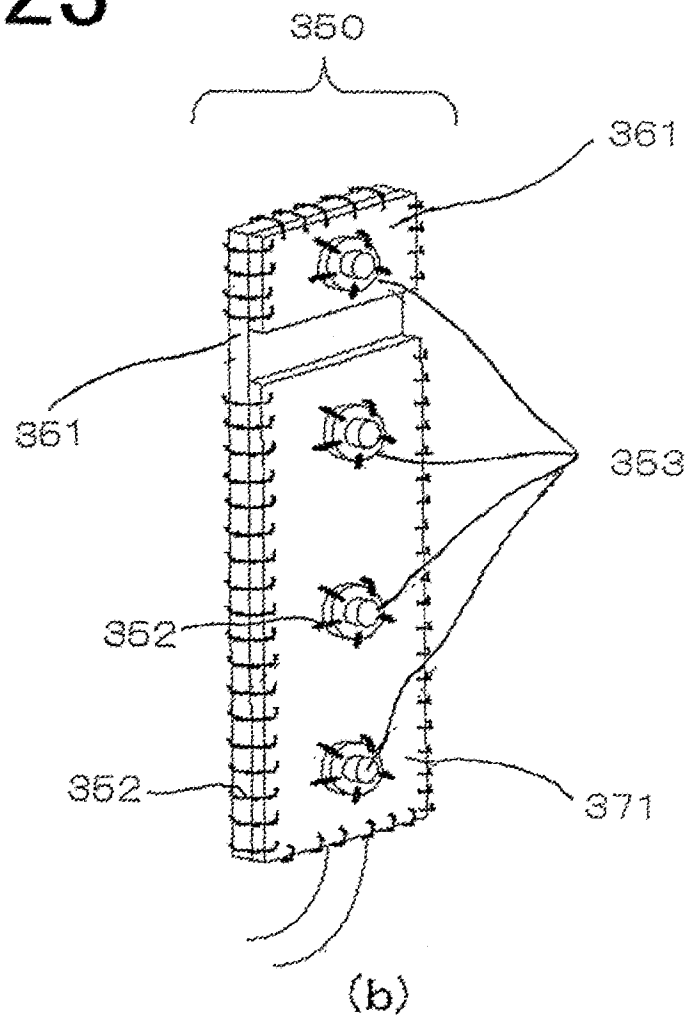
{FIG. 23} A detail view of a power feeding unit according to the fourteenth embodiment.
Figure 23:
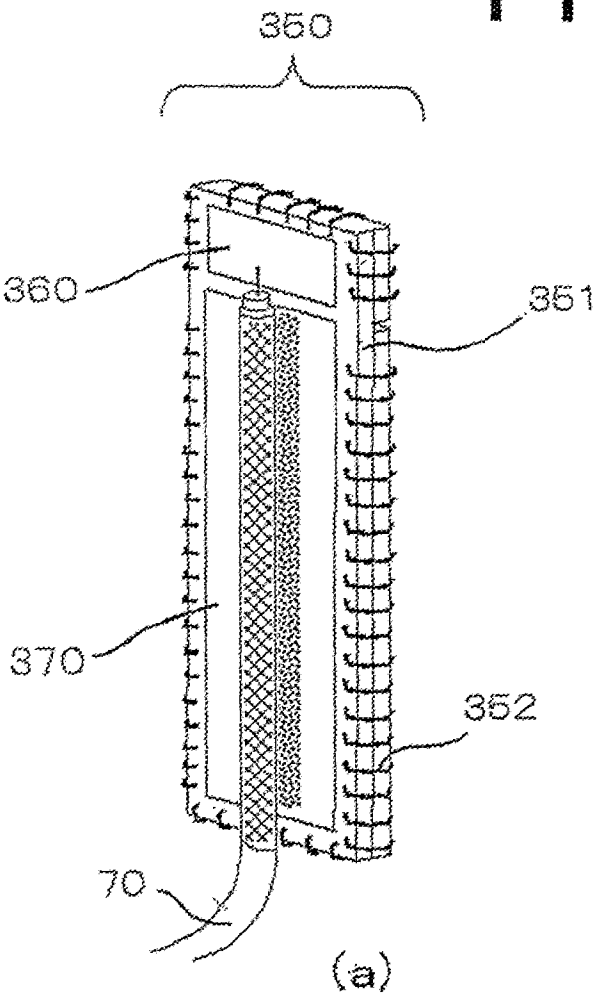

FIG. 23 is a detail view of the power feeding unit 350 according to the fourteenth embodiment of FIG. 22. FIG. 23(*a*) is a perspective view of the top surface; FIG. 23(*b*) is a perspective view of the under surface. The power feeding unit 350 includes conductors 361 and 371 sewed with thread 352 to a printed board 351 made with a flexible or thin printed board. The conductors 361 and 371 is made of a conductive fabric; buttons 353 are sewed with thread 352 to the undersides of the conductors 361 and 371. On the surface of the printed board 351, power feeding conductors 360 and 370 are etched as a conductive pattern substantially at the same positions as the conductors 361 and 371 so as to be substantially in the same shape as the conductors 361 and 371. The coaxial cable 70 is soldered to the power feeding conductors 360 and 370 in a similar way to that of FIG. 21. In the power feeding unit 350, there is capacitance between the power feeding conductor 360 and the conductor 361 and between the power feeding conductor 370 and the conductor 371. Therefore, the power feeding conductors 360 and 370 and the conductors 361 and 371 are connected together in terms of high frequencies. The conductors 361 and 371 are electrically connected to the radiating elements 210 and 230 through conductive buttons 353 and 354 and electricity is fed. Instead of buttons, hooks may be used.

Fifteenth Exemplary Embodiment

Figure 24:
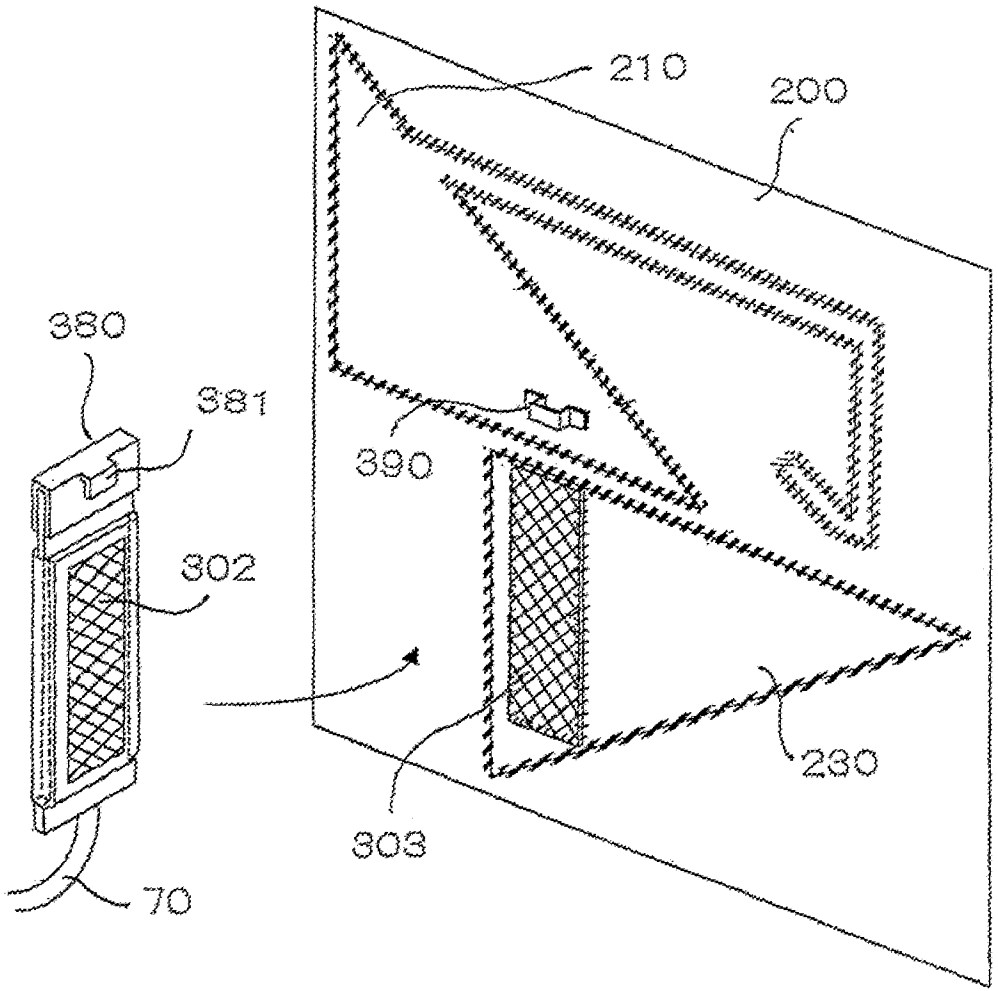
{FIG. 24} A configuration diagram of a wideband antenna according to a fifteenth exemplary embodiment of the present invention.

FIG. 24 is a configuration diagram of a wideband antenna according to a fifteenth exemplary embodiment of the present invention. The configuration of FIG. 24 and that of FIG. 20 or 21 are different in that a power feeding unit 380 has a different structure and the power feeding unit 380 is mounted not only with the magic tapes 302 and 303 but also hooks 381 and 390. Needless to say, the power feeding unit 380 can be mounted only with hooks.

The power feeding unit 380 includes the hook 381 and the magic tape 302, which are fitted on the hook 390 and the magic tape 303 when the power feeding unit 380 is firmly stuck to the base 200 for feeding electricity to the radiating elements 210 and 230.

Figure 25:
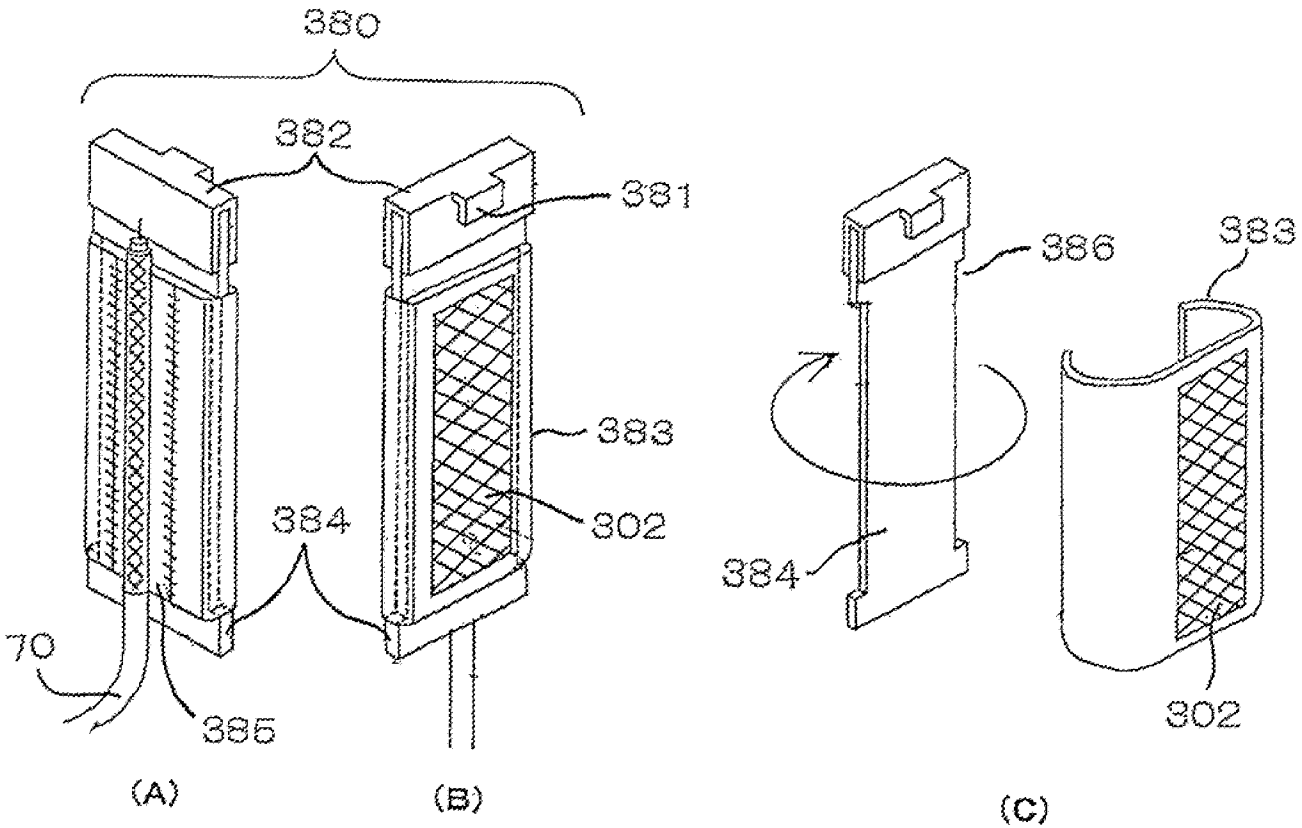
{FIG. 25} A detail view of a power feeding unit according to the fifteenth embodiment.

FIG. 25(A) shows the top surface of the power feeding unit 380. FIG. 25(B) shows the under surface. FIG. 25(C) is an assembly diagram.

As shown in FIGS. 25(A) to (C), the power feeding unit 380 includes a metal part 382 functioning as a conductor, an insulating substrate 384, a printed board 385, and the magic tape 302. The hook 381 is formed integrally with the metal part 382.

To form the power feeding unit 380, the metal part 382 is firmly attached to the tip of the insulating substrate 384 and a conductive fabric 383 having the magic tape 302 is wound on the insulating substrate 384 before being sewed together.

As shown in FIG. 25(A), which illustrates the top surface, on the top surface of the power feeding unit 380, a thin printed board 385 such as a flexible board is sewed together and firmly attached.

The conductive fabric 383 is put on a conductive pattern section of the printed board 385 and sewed to the conductive pattern section, ensuring an electrical connection between the conductive fabric 383 and the conductive pattern section.

A concave section 386 is provided on the insulating substrate 384, making it difficult for the conductive fabric 383 to slip off when being wound on the insulating substrate 384.

Electricity is fed to the radiating element 210 because the hooks 381 and 390 are electrically connected.

Electricity is fed to the radiating element 230 because the capacitance between the conductive fabric 383 and the radiating element 230 enables the conductive fabric 383 and the radiating element 230 to be connected in terms of high frequencies.

Sixteenth Exemplary Embodiment

Figure 26:
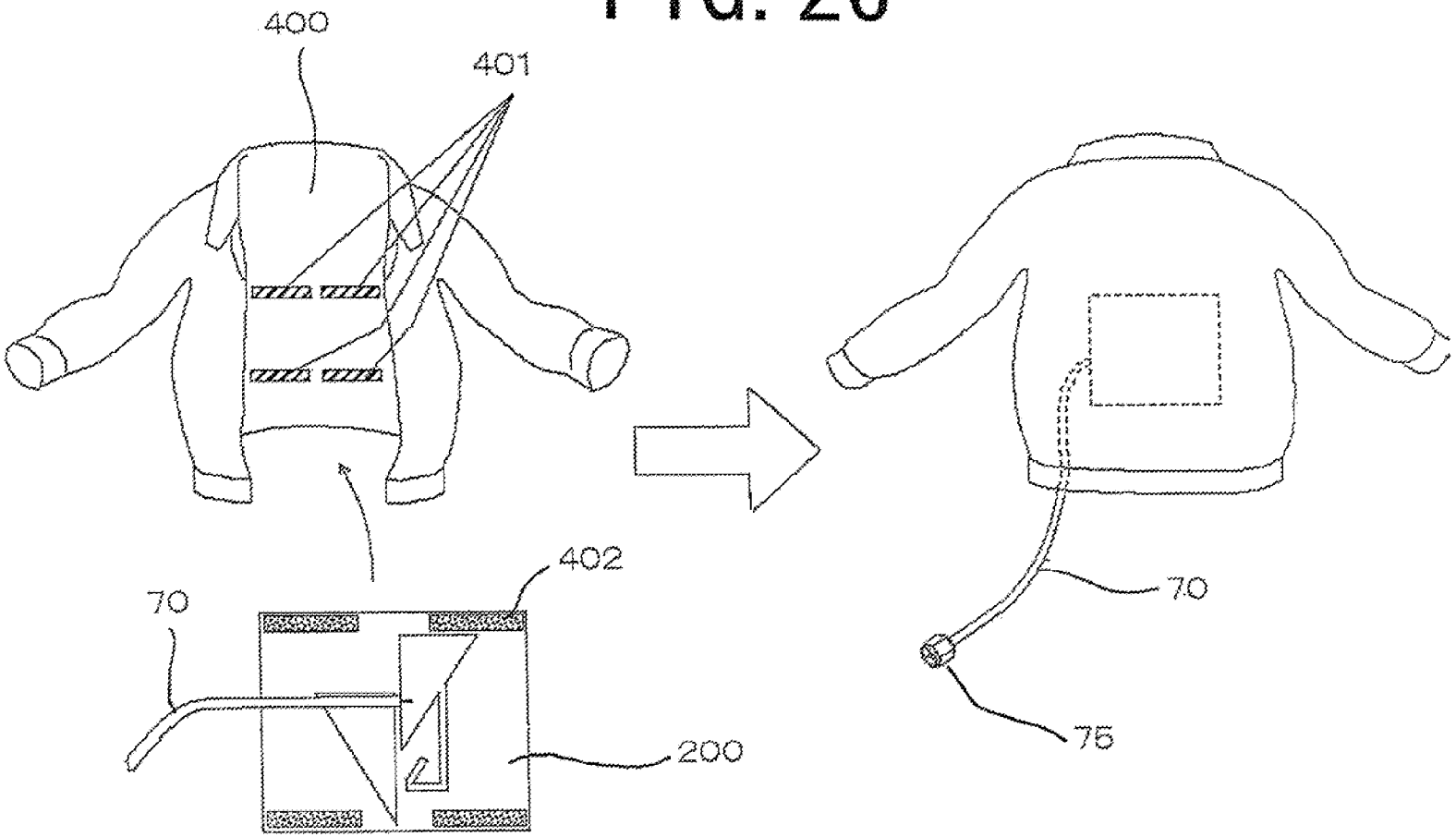
{FIG. 26} A configuration diagram of wear to which a wideband antenna is attached, according to a sixteenth exemplary embodiment of the present invention.

FIG. 26 is a configuration diagram of wear to which a wideband antenna is attached according to a sixteenth exemplary embodiment of the present invention. A wideband antenna is attached to wear 400 by means of Magic Tape (Registered Trademark) 401. The base 200 to which the wideband antenna is attached has a magic tape 402, which is fitted on the magic tape 401 of the wear 400, allowing the wideband antenna to be easily removed. A connector 75 is connected to the tip of the coaxial cable 70, enabling the wideband antenna to be connected to required devices.

Seventeenth Exemplary Embodiment

Figure 27:
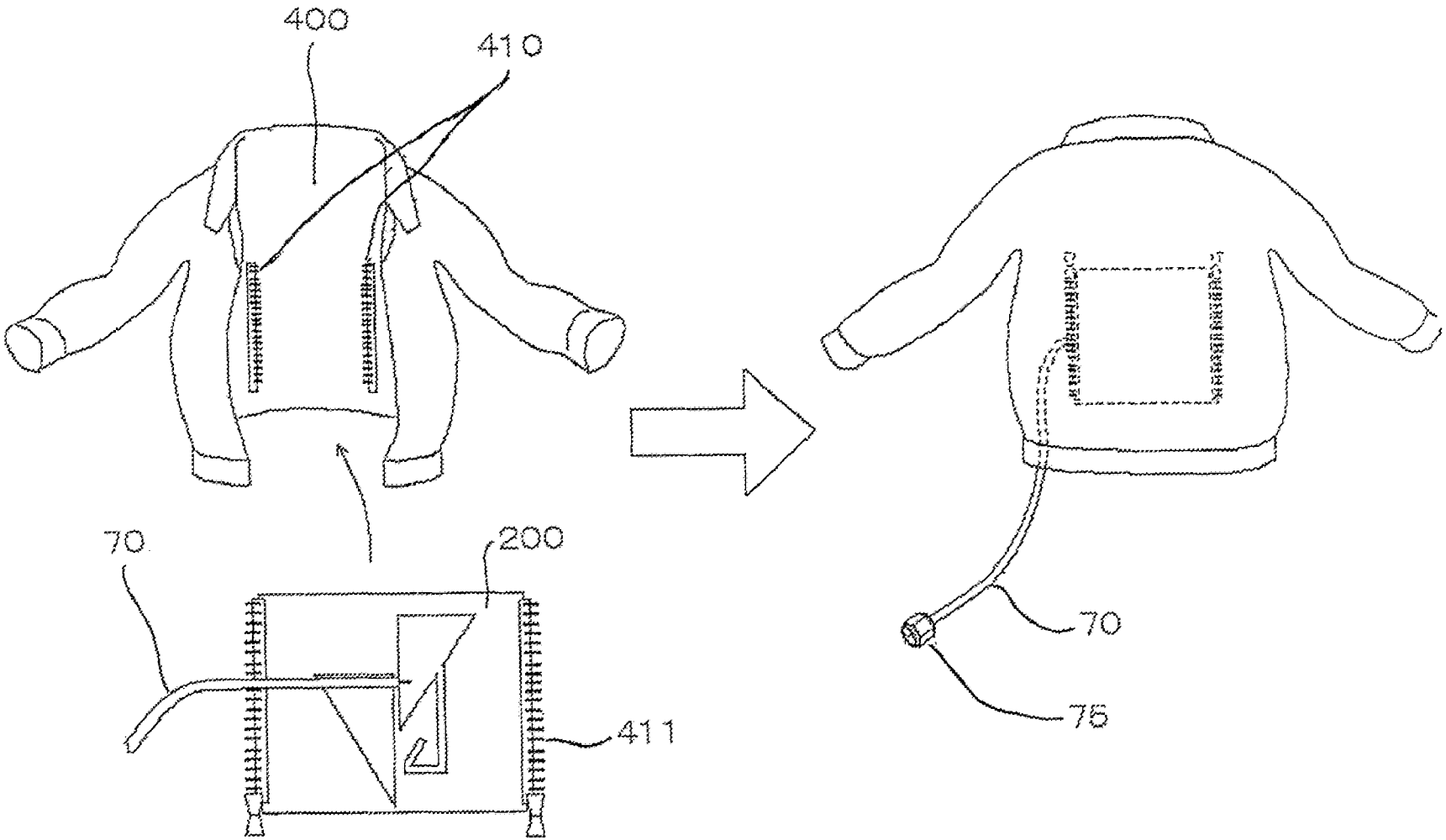
{FIG. 27} A configuration diagram of wear to which a wideband antenna is attached, according to a seventeenth exemplary embodiment of the present invention.

FIG. 27 is a configuration diagram of wear to which a wideband antenna is attached according to a seventeenth exemplary embodiment of the present invention. The configuration of FIG. 27 and that of FIG. 26 are different in that one side 410 of zipper is added to the wear 400, and the other side 411 to the base 200, enabling the wideband antenna to be fitted on the wear 400.

Eighteenth Exemplary Embodiment

Figure 28:
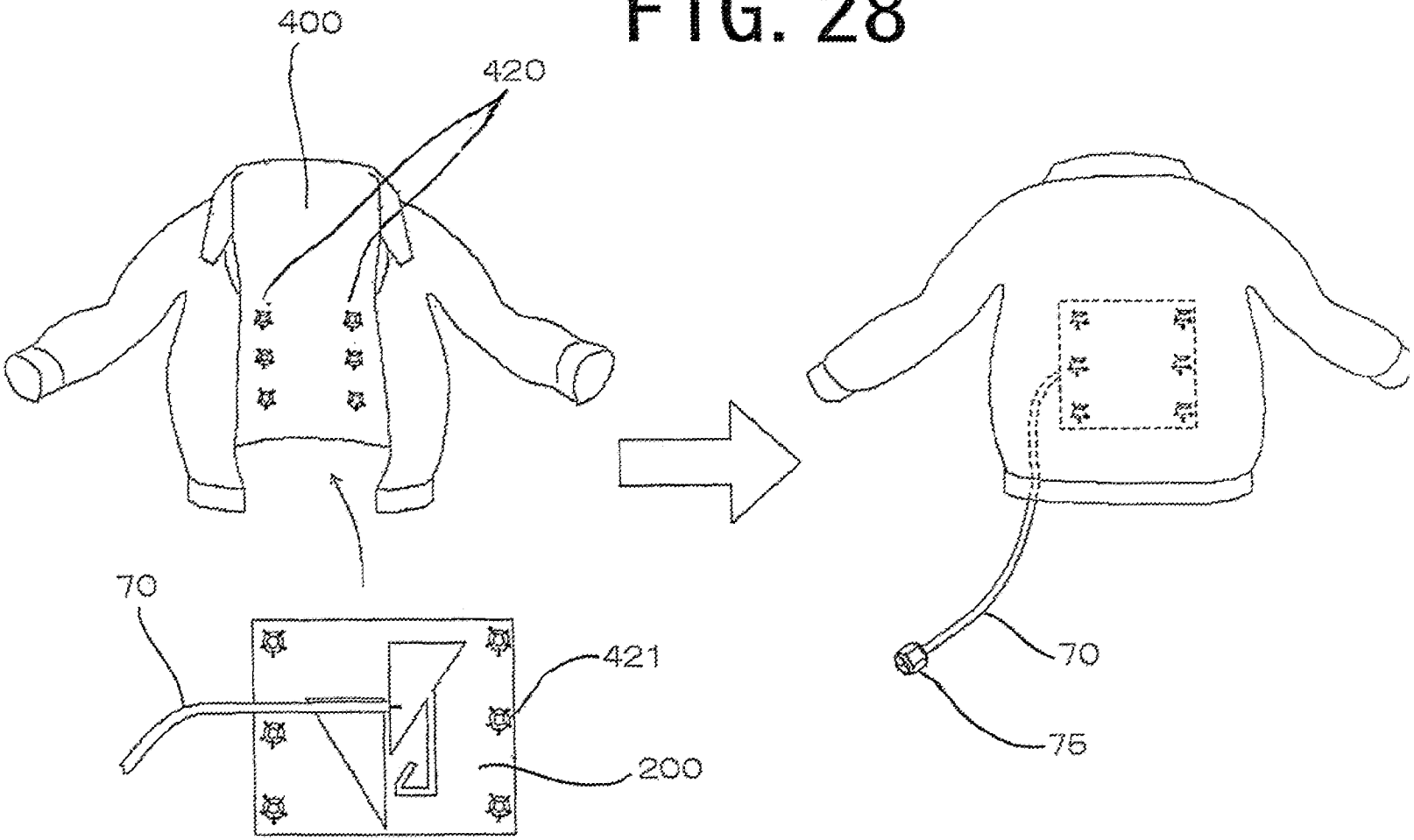
{FIG. 28} A configuration diagram of wear to which a wideband antenna is attached, according to an eighteenth exemplary embodiment of the present invention.

FIG. 28 is a configuration diagram of wear to which a wideband antenna is attached according to an eighteenth exemplary embodiment of the present invention. The configuration of FIG. 28 and that of FIG. 26 are different in that the wideband antenna is fitted on the wear 400 by means of buttons 420 and 421.

Nineteenth Exemplary Embodiment

Figure 30:
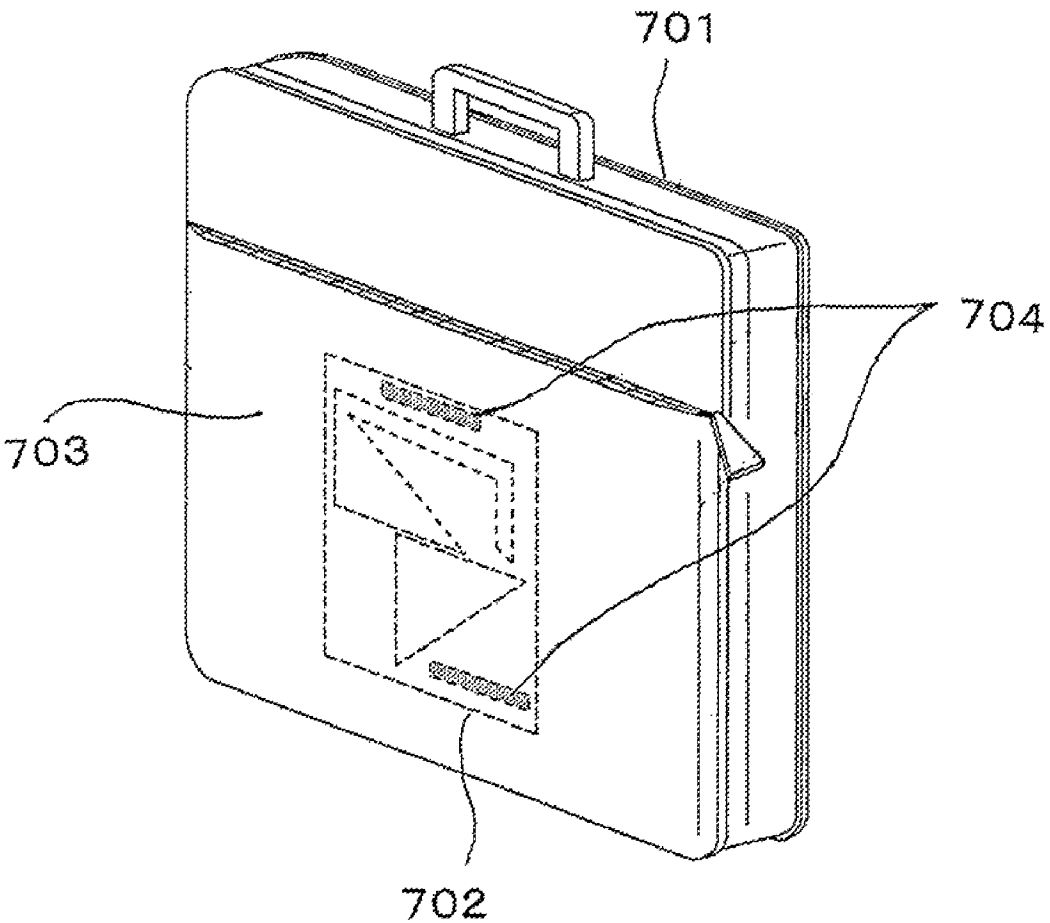
{FIG. 30} A configuration diagram of a bag to which a wideband antenna is attached, according to a nineteenth exemplary embodiment of the present invention.

FIG. 30 is a configuration diagram of a bag to which a wideband antenna is attached according to a nineteenth exemplary embodiment of the present invention. According to the present exemplary embodiment, a wideband antenna 702 is attached to a bag 701 by means of Magic Tape (Registered Trademark) 704. The magic tape 704 represents two sides of magic tape put together. One side of magic tape on a fabric 703 of a side pocket of the bag 701 and the other side on the wideband antenna 702 are joined when the wideband antenna 702 is fitted on the bag 701, enabling the wideband antenna 702 to be easily removed.

The above has described the exemplary embodiments of the present invention; the following shows actually measured data.

Figure 29:
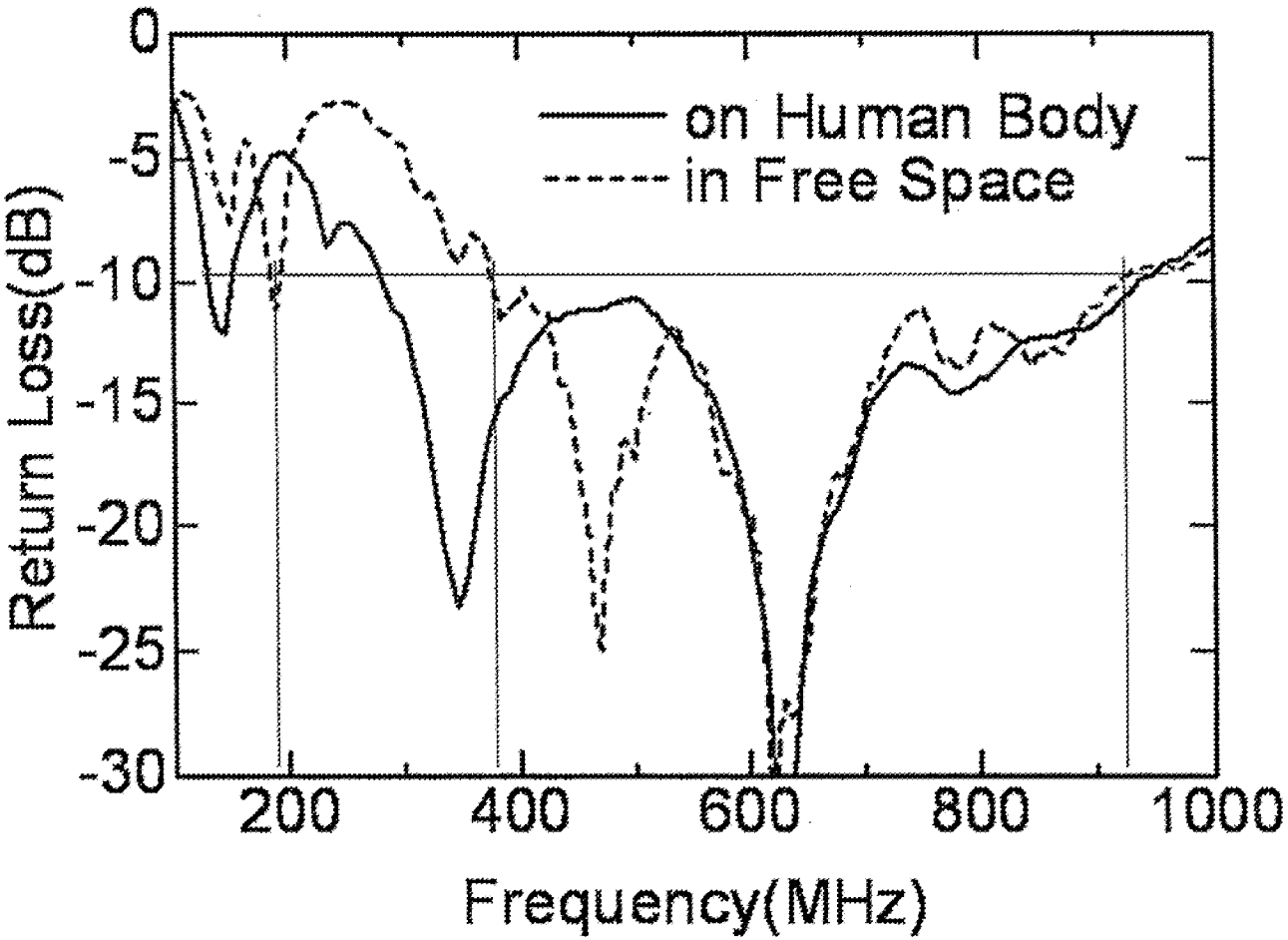
{FIG. 29} A diagram showing return-loss characteristics of a wideband antenna according to the present invention.

FIG. 29 shows values obtained by actually measuring return-loss characteristics of a prototype of the present invention's wideband antenna: the radiating elements 10 and 30 are the same in shape, with the configuration of FIG. 14. The material used for the radiating elements is a conductive fabric. The prototype is designed with the center frequency of the low-frequency band set at 190 MHz and the lower-limit frequency of the high-frequency band at 420 MHz. In this case, the dimensions of the portions illustrated in FIG. 3 are as follows: A1=A2=180 mm, B1=B2=120 mm, C1=100 mm, D=4 mm, E=15 mm, and F=380 mm. As for the measured return-loss characteristics, in the low-frequency band, the return loss is less than or equal to −9.5 dB around 190 MHz for which the prototype is designed, i.e. less than or equal to VSWR<2.0 is obtained; in the high-frequency band, the return loss is less than or equal to −9.5 dB in the range of 380 MHz to 920 MHz that covers the lower-limit design frequency of 420 MHz, i.e. less than or equal to VSWR<2.0 is obtained. In particular, an extremely wideband characteristic is obtained in the high-frequency band, in which case the fractional bandwidth is about 83%.

The results have proved the following:

(1) The antenna can be used for low- and high-frequency bands and obtain an extremely wideband characteristic in the high-frequency band; and (2) In the case described above, in the high-frequency band, the antenna exhibits an excellent return-loss characteristic in a wide band even when being put in a free space or close to a human body, i.e. it should be understood that large input impedance mismatching does not occur even when the antenna is firmly affixed to a human body.

What is described as an example in the sixteenth to eighteenth exemplary embodiments is the wideband antenna of the present exemplary embodiment that is attached to wear such as blazers and jackets. However, the wideband antenna may be attached to coats, skirts, trousers, mufflers, hats and the like, which are also regarded as wear. The wideband antenna may be attached not only to those closely fitted on a human body but also belongings such as bags, knapsacks and soft cases for personal computers. The wideband antenna may be attached to the surfaces or inner sides of wear or belongings such as bags. The wideband antenna may be attached to the side pockets of bags, knapsacks, soft cases for personal computers and the like. The nineteenth exemplary embodiment is an example in which the wideband antenna is attached to the side pocket of the bag. A base to which the wideband antenna is attached can just function as a sheet antenna and the base can be put in a bag or the like.

The wideband antenna described in each of the above exemplary embodiments can be used for at least two frequency bands; in a higher band, the wideband antenna has a wideband characteristic, which means the wideband antenna can be used in an extremely wide frequency band. In particular, in the higher frequency band, more than 83 percent of the band can be obtained in terms of fractional bandwidth.

The following looks at an example in which such an antenna is applied to current systems.

The antenna can be used as an antenna for receiving digital radio in the band of 190 MHz in a lower band and also as a specific low power radio antenna (used in the band of 400 MHz) or an antenna for receiving terrestrial digital television broadcasting (470 MHz to 770 MHz) in a higher band ranging from 380 MHz to 920 MHz.

The antenna can be used as an external antenna of a 800 MHz-band cellular phone in a lower band and also as an external antenna of a terminal, such as a 2 GHz-band cellular phone, a 2.4 GHz-band wireless LAN, or a 2.5 GHz- or 3.5 GHz-band WiMAX, in a higher band ranging from 2 GHz to 4 GHz.

Another way is to use the antenna as a 950 MHz-band RFID antenna in a lower band and as a RFID antenna in a higher band of 2.4 GHz.

In particular, the impedance characteristic of the antenna does not deteriorate even when the antenna is fitted closely on a dielectric such as a human body. Therefore, the antenna works effectively even as an RFID antenna attached to a container filled mainly with a dielectric such as drinking water. In the field of RFID, the problem is that many RFID tags cannot read data properly when being attached to a container filled mainly with a dielectric such as drinking water. However, the use of the antenna makes it possible to read data.

In terms of structure, the antenna of the present exemplary embodiment can be made easily at low cost with the use of conductive plates and printed boards. The antenna can be also made with conductive films that can be bent and conductive fabrics, instead of conductive plates. In particular, when the antenna is made with a conductive fabric, it is difficult to provide an electrical connection between the conductive fabric and the coaxial cable with solder or the like. However, the antenna can be made in a way that does not directly solder the coaxial cable to the fabric.

The antenna can be made with conductive fabrics. Therefore, the antenna can be sewed to clothing or attached to by means of magic tapes or buttons.

When being attached to clothing for use, the antenna is very close to a human body. Even in such a case, the input impedance of the antenna does not change significantly and the matching state does not deteriorate in a higher frequency band (or a band in which the antenna has a wideband characteristic) when the antenna is being used. When very close to a human body, the input impedance of a typical antenna changes significantly and the matching state deteriorates dramatically.

The antenna is very effective as what is called "wearable antenna" because the antenna can be used integrally with closing that is closely stuck to a human body.

The above has described the exemplary embodiments of the present invention. However, the present invention may be embodied in other forms without departing from the spirit and essential characteristics defined by the appended claims. The described embodiments are therefore to be considered only as illustrative, not as restrictive. The scope of the invention is indicated by the appended claims, not by the specification or abstract. Furthermore, all modifications and alterations which come within the meaning and range of equivalency of the claims are to be embraced within the scope of the present invention.

INDUSTRIAL APPLICABILITY

The present invention may be applied town antenna for receiving terrestrial digital broadcasting, an antenna for receiving digital radio, a cellular phone, a wireless LAN, a communication antenna for WiMAX or the like, an antenna for cognitive radio and software-defined radio, and the like.

REFERENCE SIGNS LIST

10 to 16, 30 to 36, 130: Radiating elements
50 to 63, 150, 151: Strip-shaped elements
70: Coaxial cables
71: Coaxial center conductor
72: Coaxial external conductor
73, 83, 88: Solder
80, 85: Power feeding sections
81, 86: Power feeding conductors
82, 87: Insulators
100: Printed board
171: Microstrip line
172: Ground
173: Through hole

The invention claimed is:

1. A wideband antenna comprising:
a first planar radiating element and second planar radiating element that include at least two sides, wherein
at least one of the first and second radiating elements includes a strip-shaped element;
a first side of the first radiating element and a second side of the second radiating element are so disposed as to be parallel to each other, face each other and be shifted in a parallel direction; and
the strip-shaped element is so disposed as to be connected to any side other than the first and second sides of the first and second radiating elements, run parallel to the first and second sides, and not go beyond a tip positioned at the outermost point of the first and second sides.

2. The wideband antenna according to claim 1, wherein
one end of the strip-shaped element is connected to any side other than the first and second sides of the first and second radiating elements, and the other end is open.

3. The wideband antenna according to claim 1, wherein
the first and second radiating elements are substantially the same in shape.

4. The wideband antenna according to claim 1, wherein
each of the first and second radiating elements is substantially in the shape of a triangle.

5. The wideband antenna according to claim 1, wherein
each of the first and second radiating elements is substantially in the shape of one-quarter of an ellipse.

6. The wideband antenna according to claim 1, wherein
the first and second radiating elements include sides that cross the first and second sides substantially at right angles.

7. The wideband antenna according to claim 4, wherein
each of the first and second radiating elements is substantially in the shape of a right triangle.

8. The wideband antenna according to claim 1, wherein
electricity is fed to the first and second radiating elements at a point where the first and second radiating elements are shifted in the parallel direction.

9. The wideband antenna according to claim 7, wherein
the right triangle being the shape of each of the first and second radiating elements has the shape where at least a portion of one of two vertexes except a substantially right-angled portion is removed.

10. The wideband antenna according to claim 1, wherein
the other end of the strip-shaped element is in a L-shape or a J-shape.

11. The wideband antenna according to claim 1, wherein
the strip-shaped element is linear or curved.

12. The wideband antenna according to claim 1, wherein
the strip-shaped element ramifies into a plurality of elements.

13. The wideband antenna according to claim 1, wherein
the width of the strip-shaped element changes.

14. The wideband antenna according to claim 1, wherein
a plurality of the strip-shaped elements are provided.

15. The wideband antenna according to claim 1, wherein
the first and second radiating elements and the strip-shaped element can be bent and are made of a conductive material.

16. The wideband antenna according to claim 1, wherein
the first and second radiating elements and the strip-shaped element are made of a conductive fabric.

17. The wideband antenna according to claim 8, wherein
the electricity is fed through a coaxial cable, the first radiating element is connected to a center conductor of the coaxial cable, and the second radiating element is connected to an external conductor of the coaxial cable.

18. The wideband antenna according to claim 17, wherein:
at least one of the first and second radiating elements is connected to the coaxial cable through a power feeding section; and
the power feeding section includes a dielectric and a conductor section to which the coaxial cable is connected.

19. The wideband antenna according to claim 1, wherein
the shifting distance is set at between one-tenth and two-tenths of the wavelength of the lowest usable frequency.

20. The wideband antenna according to claim 18, wherein
the power feeding section is attached to at least one of the first and second radiating elements with a thread, magic tapes or buttons.

21. The wideband antenna according to claim 1, wherein
the first and second radiating elements and the strip-shaped element are formed on a surface of a printed board.

22. The wideband antenna according to claim 21, wherein
the first radiating element is formed on one side of the printed board, and the second radiating element is formed on the other side.

23. The wideband antenna according to claim 1, wherein
around the tip positioned at the outermost point of the first and second sides, the strip-shaped element is bent toward the tip.

24. The wideband antenna according to claim 4, wherein
input impedance matching of the strip-shaped element is possible by adjusting the distance from the vertex of the one that is substantially in the shape of a triangle or right triangle to a connection point.

25. Wear to which the wideband antenna claimed in claim 1 is attached.

26. Belongings to which the wideband antenna claimed in claim 1 is attached, the belongings being one of bags, knapsacks and soft cases.

* * * * *